US008550515B2

(12) United States Patent
Castillo

(10) Patent No.: US 8,550,515 B2
(45) Date of Patent: Oct. 8, 2013

(54) SNOW REMOVAL SHOVEL

(76) Inventor: Frank M. Castillo, Bourbonnais, IL (US)

( * ) Notice: Subject to any disclaimer, the term of this patent is extended or adjusted under 35 U.S.C. 154(b) by 7 days.

(21) Appl. No.: 13/331,263

(22) Filed: Dec. 20, 2011

(65) Prior Publication Data

US 2013/0154289 A1 Jun. 20, 2013

(51) Int. Cl.
*E01H 5/02* (2006.01)

(52) U.S. Cl.
USPC ..... 294/54.5; 37/285

(58) Field of Classification Search
USPC ..... 294/53.5, 54.5, 57, 58, 51; 37/278, 37/284, 285
See application file for complete search history.

(56) References Cited

U.S. PATENT DOCUMENTS

| | | | | | |
|---|---|---|---|---|---|
| 1,693,472 | A | * | 11/1928 | Batty | 37/284 |
| 3,343,807 | A | * | 9/1967 | Moraski | 254/131.5 |
| 4,888,846 | A | | 12/1989 | Natale | |
| 5,411,305 | A | * | 5/1995 | Revoldt | 294/58 |
| 5,440,828 | A | | 8/1995 | Simpson | |
| 5,716,087 | A | | 2/1998 | Backich | |
| 5,727,829 | A | * | 3/1998 | Bellichak | 294/51 |
| 5,937,627 | A | | 8/1999 | McKittrick | |
| 6,464,272 | B1 | | 10/2002 | Michaud | |
| 6,883,845 | B2 | * | 4/2005 | Douziech | 294/58 |
| 6,922,920 | B1 | | 8/2005 | Stratz | |
| 7,213,658 | B2 | | 5/2007 | Hurt | |
| 7,331,620 | B2 | * | 2/2008 | Wang | 294/58 |
| 2005/0206178 | A1 | | 9/2005 | Hoeft | |
| 2007/0013198 | A1 | | 1/2007 | Brazeau | |
| 2007/0145756 | A1 | | 6/2007 | DeWinters | |

* cited by examiner

*Primary Examiner* — Stephen Vu
(74) *Attorney, Agent, or Firm* — Parsons & Goltry; Michael W. Goltry; Robert A. Parsons

(57) ABSTRACT

A snow removal shovel includes an elongate support having an upper end and an opposed lower end, and a shovel blade having a ground engaging lower edge and an opposed upper edge, opposed side edges, a front snow-engaging side and an opposed rear side. The shovel blade is mounted to the lower end of the elongate support for pivotal movement between a snow shoveling position of the shovel blade toward the elongate support and a snow dumping position of the shovel blade away from the elongate support. A latch is mounted to the elongate support for movement between a locked position for securing the shovel blade in the snow shoveling position of the shovel blade, and an unlocked position for releasing the shovel blade in the snow shoveling position of the shovel blade for permitting the shovel blade to pivot between the snow shoveling and snow dumping positions.

22 Claims, 8 Drawing Sheets

SNOW REMOVAL SHOVEL

FIELD OF THE INVENTION

The present invention relates to snow removal shovels.

BACKGROUND OF THE INVENTION

Shoveling and removing snow with a snow shovel is difficult and challenging business, particularly when there is a large amount of snow to remove and when the snow is wet and heavy. Given the difficulty of using snow shovels to remove snow, such as from driveways, walkways, sidewalks, and other areas requiring snow removal, skilled artisans have devoted considerable efforts to improving snow shovels. However, although skilled artisans have developed varieties of snow shovels designed to attempt to improve the ease and efficiency of shoveling and removing snow and for reducing the incidence of user injury that can occur as a result of prolonged snow removal activities and that can occur when the snow is heavy and difficult to move, advances in the field of snow shovels have not been entirely satisfactory, and have yielded snow shovels that are expensive, difficult to construct, and difficult to use, thereby necessitating continued improvement in the art.

SUMMARY OF THE INVENTION

According to the principle of the invention, a snow removal shovel includes an elongate support having an upper end and an opposed lower end, and a shovel blade having a ground engaging lower edge and an opposed upper edge, opposed side edges, a front snow-engaging side and an opposed rear side. The rear side of the shovel blade defines a middle between, and equidistant with respect to, the ground engaging lower edge and the upper edge, an upper section extending between the middle and the upper edge, and a lower section extending between the middle and the ground engaging lower edge. The lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade. The shovel blade pivots at the pivot point between a snow shoveling position of the shovel blade toward the elongate support and a snow dumping position of the shovel blade away from the elongate support. In the snow shoveling position of the shovel blade the upper edge of the shovel blade and the rear side of the shovel blade between the pivot point and the upper edge of the shovel blade are juxtaposed with respect to the elongate support. In the snow dumping position of the shovel blade the upper edge of the shovel blade and the rear side of the shovel blade between the pivot point and the upper edge of the shovel blade are positioned downwardly and away from the elongate support. A latch is mounted to the elongate support between a locked position for engaging the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position for disengaging the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade. A handle is operatively coupled to the latch to move the latch between the locked and unlocked positions in response to movement of the handle between a locking position and an unlocking position. The handle is located near the upper end of the elongate support. A spring is coupled between the elongate support and the latch for biasing the latch into the locked position. A handgrip is formed in the upper end of the elongate support. The handle is positioned near the handgrip so as to permit the handle and the handgrip to be concurrently taken up by hand to wield the snow removal shovel and to move the handle between the locking and unlocking positions for moving the latch between the locked and unlocked positions. An arm-receiving cradle is coupled to the handgrip. A brace is coupled between, on the one hand, the handgrip and the cradle and, on the other hand, an intermediate portion of the elongate support between the upper and lower ends of the elongate support. The brace extends between, on the one hand, the handgrip and the cradle, and, on the other hand, the intermediate portion of the elongate support so as to provide leverage to the intermediate portion of the elongate support from the arm-receiving cradle and the handgrip to assist a user in wielding the shovel during snow removal/shoveling. A spring assembly is coupled between the shovel blade and the elongate support for biasing the shovel blade into the snow shoveling position of the shovel blade. The spring assembly includes a plurality of springs, and the spring assembly is preferably coupled between the rear side of the shovel blade and the elongate support. In a preferred embodiment, the plurality of springs is coupled between the elongate support between the latch and the pivot point, and the upper section of the rear side of the shovel blade.

According to the principle of the invention, a snow removal shovel includes an elongate support having an upper end and an opposed lower end, and a shovel blade having a ground engaging lower edge and an opposed upper edge, opposed first and second side edges, a front snow-engaging side and an opposed rear side. The rear side of the shovel blade defines a middle between and equidistant with respect to the ground engaging lower edge and the upper edge, an upper section extending between the middle and the upper edge, and a lower section extending between the middle and the ground engaging lower edge. The lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade. The shovel blade pivots at the pivot point between a snow shoveling position of the shovel blade toward the elongate support and a snow dumping position of the shovel blade away from the elongate support. In the snow shoveling position of the shovel blade the upper edge of the shovel blade and the rear side of the shovel blade between the pivot point and the upper edge of the shovel blade are juxtaposed with respect to the elongate support. In the snow dumping position of the shovel blade the upper edge of the shovel blade and the rear side of the shovel blade between the pivot point and the upper edge of the shovel blade are positioned downwardly and away from the elongate support. A latch is mounted to the elongate support between a locked position for engaging the upper edge of the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position for disengaging the upper edge of the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade. A handle is operatively coupled to the latch to move the latch between the locked and unlocked positions in response to movement of the handle between a locking position and an unlocking position. The handle is located near the upper end of the elongate support. A spring coupled between the elongate support and the latch for biasing the latch into the locked position. A handgrip is formed in the upper end of the elongate support. The handle is positioned near the handgrip so as to permit the handle and the handgrip to be concurrently taken up by hand to wield the snow removal shovel and to move the handle between the locking and unlocking positions for moving the latch between the locked and unlocked positions. An arm-receiving cradle coupled to the handgrip, and a brace is coupled between, on the one hand, the handgrip and the cradle and, on the other hand, an intermediate portion of the elongate support between the upper and lower ends of the elongate support. The brace extends between, on the one hand, the handgrip and the cradle, and, on the other hand, the intermediate portion of the elongate support so as to provide leverage to the intermediate portion of the elongate support from the arm-receiving cradle and the handgrip to assist a user in wielding the shovel during snow removal/shoveling. A spring assembly is coupled between the shovel blade and the elongate support for biasing the shovel blade into the snow shoveling position of the shovel blade. The spring assembly includes a first spring and a second spring, and the first and second springs are preferably coupled between the rear side of the shovel blade and the elongate support. Specifically, the first spring has a first tag end coupled to the elongate support between the latch and the pivot point, a second tag end coupled to the upper section of the rear side of the shovel blade near the upper edge of the shovel blade and the first side edge of the shovel blade, and the first spring lengthens and shortens in response to movement of shovel blade between the snow shoveling and snow dumping positions. The second spring has a third tag end coupled to the elongate support between the latch and the pivot point, a fourth tag end coupled to the upper section of the rear side of the shovel blade near the upper edge of the shovel blade and the second side edge of the shovel blade, and the second spring lengthens and shortens in response to movement of shovel blade between the snow shoveling and snow dumping positions.

According to the principle of the invention, a snow removal shovel includes an elongate support having an upper end formed with a handgrip, and an opposed lower end, and a shovel blade having a ground engaging lower edge and an opposed upper edge, opposed first and second side edges, a front snow-engaging side and an opposed rear side. The rear side of the shovel blade defines a middle between and equidistant with respect to the ground engaging lower edge and the upper edge, an upper section extending between the middle and the upper edge, and a lower section extending between the middle and the ground engaging lower edge. The lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade. The shovel blade pivots at the pivot point between a snow shoveling position of the shovel blade toward the elongate support and a snow dumping position of the shovel blade away from the elongate support. In the snow shoveling position of the shovel blade the upper edge of the shovel blade and the rear side of the shovel blade between the pivot point and the upper edge of the shovel blade are juxtaposed with respect to the elongate support. In the snow dumping position of the shovel blade the upper edge of the shovel blade and the rear side of the shovel blade between the pivot point and the upper edge of the shovel blade are positioned downwardly and away from the elongate support. An elongate rod has a proximal end formed with a handle and an opposed distal end formed with a latch. The elongate rod is carried by the elongate support and extends along the elongate support from the handle located near the handgrip, and the latch located near the upper edge of the shovel blade. The elongate rod is further mounted to the elongate support for reciprocal movement between a locked position of the latch engaging the upper edge of the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position of the latch disengaging the upper edge of the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade. The handle is positioned near the handgrip so as to permit the handle and the handgrip to be concurrently taken up by hand for wielding the snow removal shovel and for reciprocating the elongate rod for moving the latch between the locked and unlocked positions. The elongate rod between the proximal and distal ends is parallel with respect to the elongate support. A spring is coupled between the elongate support and the latch for biasing the elongate rod into the locked position of the latch. An arm-receiving cradle coupled to the handgrip, and a brace is coupled between, on the one hand, the handgrip and the cradle and, on the other hand, an intermediate portion of the elongate support between the upper and lower ends of the elongate support. The brace extends between, on the one hand, the handgrip and the cradle, and, on the other hand, the intermediate portion of the elongate support so as to provide leverage to the intermediate portion of the elongate support from the arm-receiving cradle and the handgrip to assist a user in wielding the shovel during snow removal/shoveling. A spring assembly is coupled between the shovel blade and the elongate support for biasing the shovel blade into the snow shoveling position of the shovel blade. The spring assembly is preferably coupled between the rear side of the shovel blade and the elongate support, and includes a first spring and a second spring. The first spring has a first tag end coupled to the elongate support between the latch and the pivot point, a second tag end coupled to the upper section of the rear side of the shovel blade near the upper edge of the shovel blade and the first side edge of the shovel blade, and the first spring lengthens and shortens in response to movement of shovel blade between the snow shoveling and snow dumping positions. The second spring has a third tag end coupled to the elongate support between the latch and the pivot point, a fourth tag end coupled to the upper section of the rear side of the shovel blade near the upper edge of the shovel blade and the second side edge of the shovel blade, and the second spring lengthens and shortens in response to movement of shovel blade between the snow shoveling and snow dumping positions.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION

Figure 1:
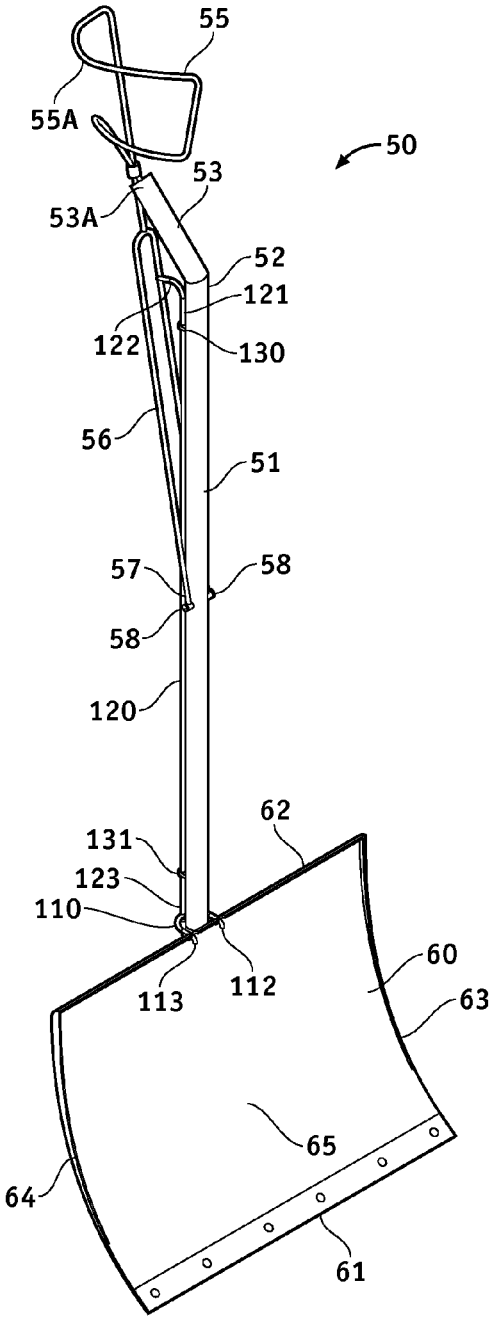
FIG. 1 is a front perspective view of a snow removal shovel constructed and arranged in accordance with the principle of the invention, the show removal shovel including an elongate support having an upper end formed with a handgrip, and an opposed lower end, a shovel blade attached to the lower end of the elongate support, and an elongate rod having a proximal end formed with a handle located near the handgrip formed in the proximal end of the elongate support, and an opposed distal end formed with a latch positioned in a locked position engaging the shovel blade and securing the shovel blade in a snow shoveling position of the shovel blade.
Figure 2:
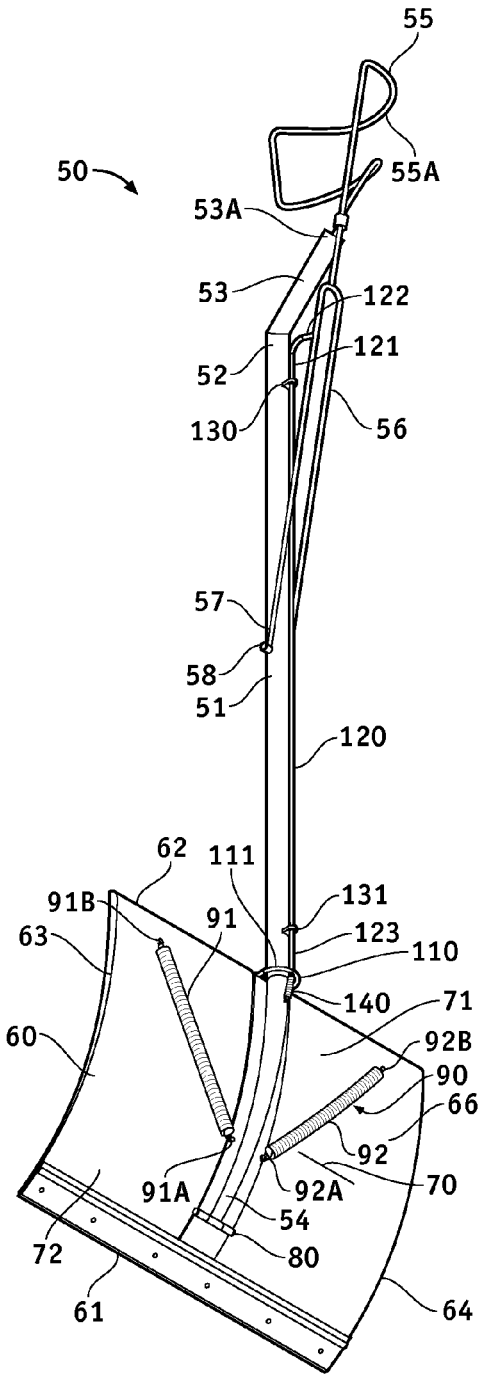
FIG. 2 is a rear perspective view of the snow removal shovel of FIG. 1.

Turning now to the drawings, in which like reference characters indicate corresponding elements throughout the several views, attention is first directed to FIG. 1 and FIG. 2 in which there is seen a snow removal shovel 50 including an elongate shaft or support 51 having an upper end 52, formed with a handgrip 53 capable of being taken up by hand, and an opposed lower end 54, and a shovel blade 60 mounted to lower end 52 of elongate support 51. Handgrip 53 is angled relative to elongate support 51 and is exemplary of a pistol-grip type handgrip, and terminates upwardly with a free or distal end 53A. Elongate support 51 is five feet in overall length from handgrip 53 to lower end 54 to facilitate use of shovel 50 by a user in a standing position. Elongate shaft 50 may be formed of other lengths as may be desired so as to facility use of shovel 50 by a user in a standing position. If desired, elongate shaft 51 may be adjustable between shortened and lengthened conditions for adjusting the length of elongate support 51 to facilitate use of shovel 50 by users of differing height. In this aspect, elongate support 51 may be formed by two or more telescoping members.

Elongate shaft 51 and shovel blade 60 are each formed of plastic, aluminum, steel, or other material or combination of materials having the properties of rigidity, flexibility, and ruggedness so as to withstand repeated use in cold and snowy conditions as is typical with conventional snow shovels. Shovel blade 60 has a ground engaging lower edge 61 and an opposed upper edge 62, opposed side edges 63 and 64, a front snow engaging face or side 65 shown in FIG. 1, and an opposed rear face or side 66 shown in FIG. 2. Ground engaging lower edge 61 is parallel with respect to upper edge 62, side edge 63 is parallel with respect to side edge 64, front snow engaging side 65 is inwardly curved or concave in a horizontal direction from side edge 63 of shovel blade 60 to side edge 64 of shovel blade 60, and rear side 66 is outwardly curved or convex in the horizontal direction from side edge 63 of shovel blade 60 to side edge 64 of shovel blade 60. Ground engaging lower edge 61 and upper edge 62 are equal in length, and side edges 63 and 64 are equal in length. Furthermore, in this preferred embodiment the height of shovel blade 60 from ground engaging lower edge 61 to upper edge is fifteen inches, and the width of shovel blade 60 from side edge 63 to side edge 64 is eighteen inches. As such, ground engaging lower edge 61 and upper edge 62 are each eighteen inches in length, and side edges 63 and 64 are each fifteen inches in length.

Figures 16, 17, 18:
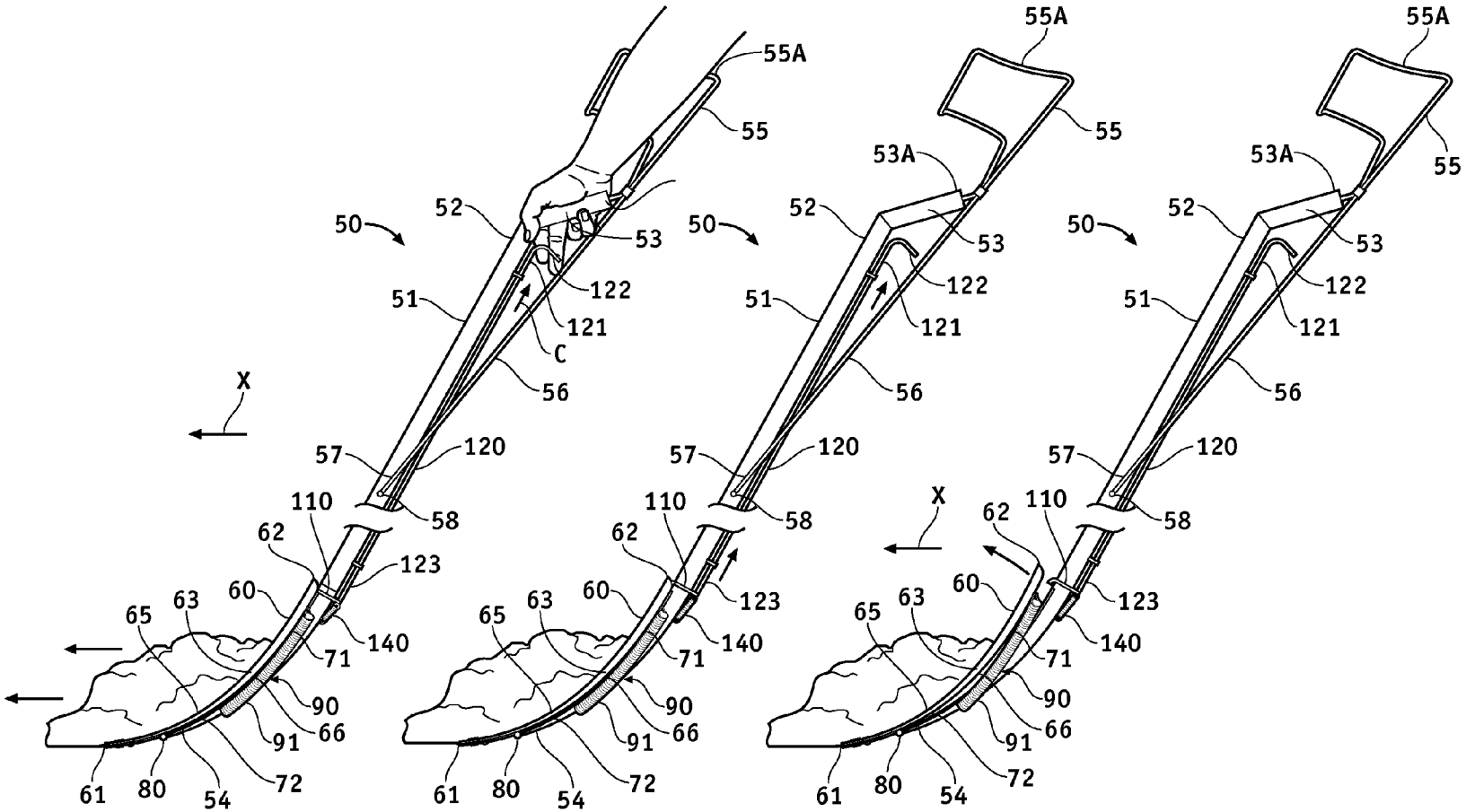
FIGS. 16-21 show a sequence of operation of the snow removal shovel of FIG. 1.

Handgrip 53 is capable of being taken up by hand for wielding shovel for manual snow removal as shown in FIG. 16. To assist a user in wielding shovel 50, such as by just one arm, shovel 50 is formed with a cradle 55. Cradle 55 is an arm-receiving cradle and, in this specific embodiment, is an openwork of bent or formed rod fashioned of metal or plastic, and is secured to, integrated with, and associates with the distal or free end of handgrip 53 as seen in FIGS. 1, 2, 6, 7, and 16-21. Cradle 55 is attached to or otherwise integrated with handgrip 53 and extends rearwardly of handgrip 53, and when handgrip 53 is taken up by hand to wield shovel 50 for manual snow removal as shown in FIG. 16, cradle 55 is available and positioned upwardly from handgrip 53 to receive therein the forearm portion of an arm of the user, which provides the user with additional leverage and control in wielding shovel 50. Referencing FIGS. 1 and 11, cradle 55 is formed with an extension consisting of a brace 56, which is coupled between, on the one hand, handgrip 53 and cradle 55 and, on the other hand, an intermediate portion of elongate support 51 between upper or proximal end 52 and lower or distal end 54 of elongate support 51. Brace 56 provides leverage to the intermediate portion or middle of elongate support from cradle 55 and handgrip 53 to assist a user in wielding shovel 50 in the use of shovel 50 in removing/shoveling snow.

Specifically, brace 56 is coupled between, on the one hand, cradle 55 and free or distal end 53A of handgrip 53 and, on the other hand, an intermediate portion or middle of elongate support 51 between upper or proximal end 52 and lower or distal end 54. Brace 56 is formed of the same rod used to form cradle 55, and is bifurcated into opposed forks that terminate with free ends 57 referenced in FIG. 11, which are located on either side of elongate support 51 and which are secured in place to elongate support 51 with corresponding pins 58. Brace 56 is formed along the rear of elongate support 51 between handgrip 53 and an intermediate portion or middle of elongate support 51, is down-angled inwardly to the intermediate portion or middle of elongate support 51 from distal end 53A of handgrip 53 and cradle 55, imparts rigidity to elongate support 51, and provides additional leverage against elongate support 51 from cradle 55 from a user's forearm to assist a user in wielding device during manual snow removal. The application of brace 56 coupled between, on the one hand, cradle 55 and handgrip 53 and, on the other hand, the intermediate portion or middle of elongate support 51 as shown and described acts as a leveraging or pivoting structure at free or distal end 53 of handgrip 53 between cradle 55 and the intermediate portion or middle of elongate support 51 and provides leverage from cradle 55 to the intermediate portion or middle of elongate support 51, whereby force applied to cradle 55 from a user's arm positioned in cradle is leveraged or otherwise transferred by brace 56 from handgrip 53 and cradle 55 to the intermediate portion or middle of elongate support 51, and this force applied to the intermediate portion or middle of elongate support 51 from cradle 55 and handgrip 53 to the intermediate portion or middle of elongate support 51 by brace 56 by a user's arm in cradle 55 assists the user in moving elongate support 51 in the user of shovel 50 in the removal and shoveling of snow, in accordance with the principle of the invention.

Figure 11:
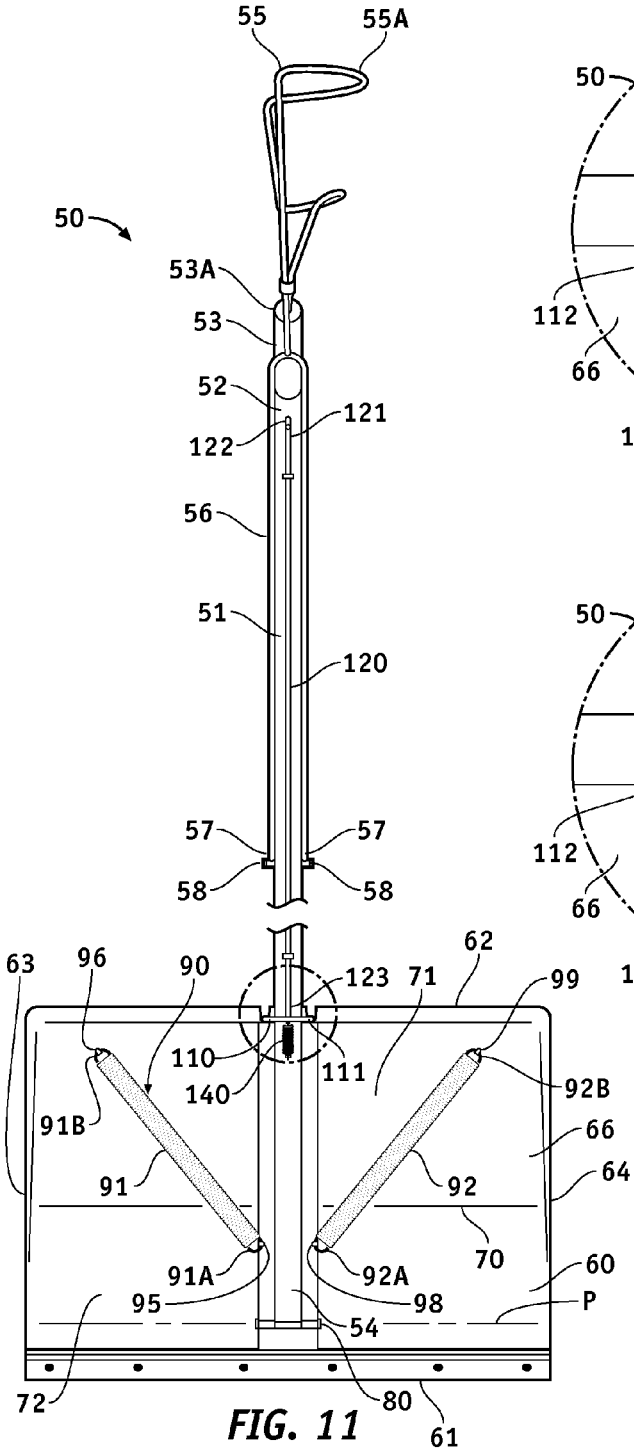
FIG. 11 is a rear elevation view of the snow removal shovel of FIG. 1.

Referencing FIG. 2 and FIG. 11, rear side 66 of the shovel blade defines a middle section or simply a middle denoted generally at 70, an upper area or section denoted generally at 71, and an opposed lower area or section denoted generally at 72. Middle 70 is the horizontal geometric center of rear side 66 of shovel blade 60. Further with respect to middle 70, middle 70 is defined at a point that extends horizontally across rear side 66 of shovel blade 60 from side edge 63 to side edge 64, and middle 70 is between, and equidistant with respect to, and parallel with respect to ground engaging lower edge 61 and upper edge 62 of shovel blade 60. Upper and lower sections 71 and 72 are located on either side of middle 70, and are coextensive. Upper section 71 extends between side edges 63 and 64 of shovel blade 60 and between middle 70 and upper edge 62 of shovel blade 60. Lower section 72 extends between side edges 63 and 64 of shovel blade 60 and between middle 70 and ground engaging lower edge 61.

Figures 19, 20, 21:
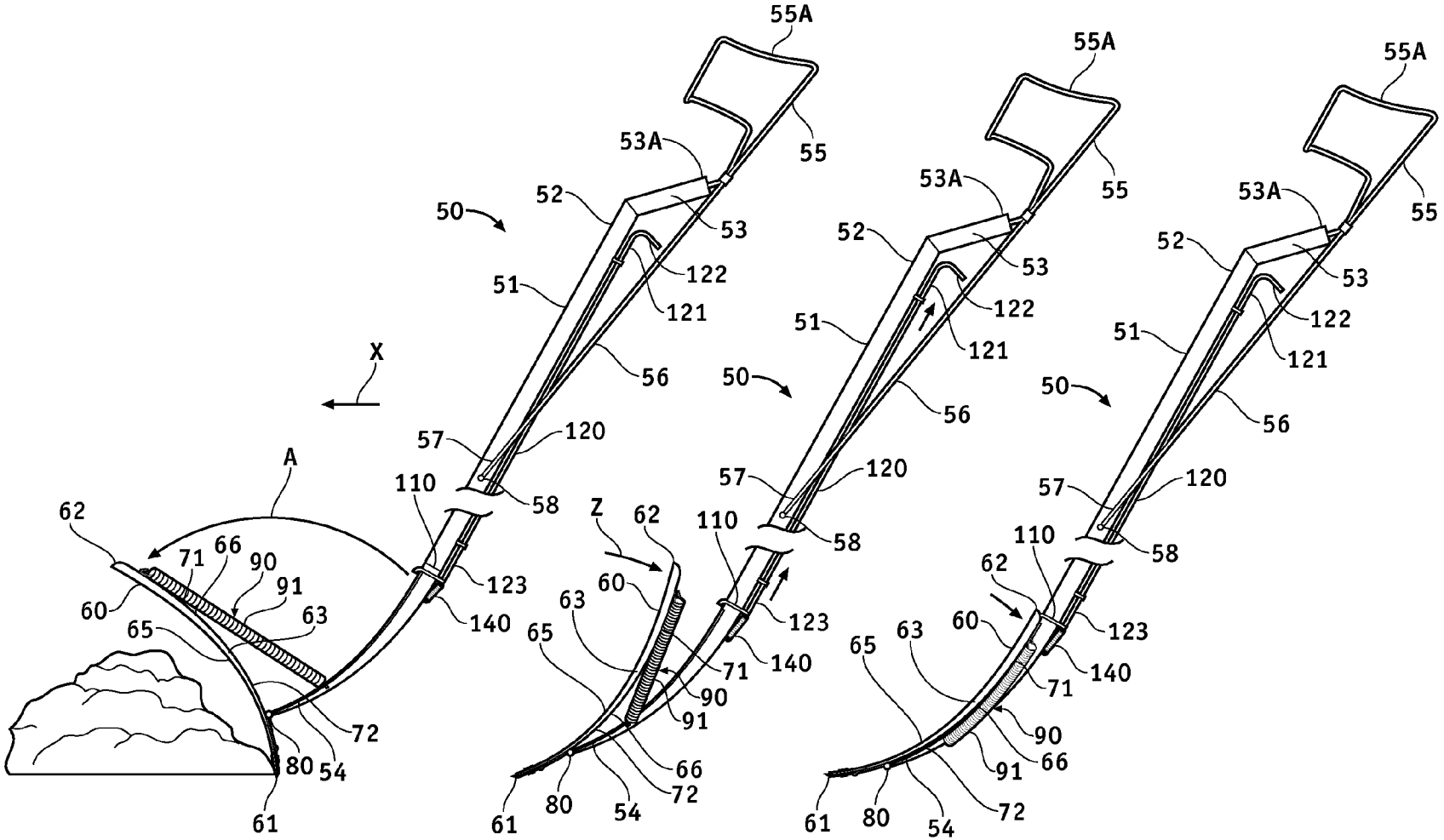
Figure 22:
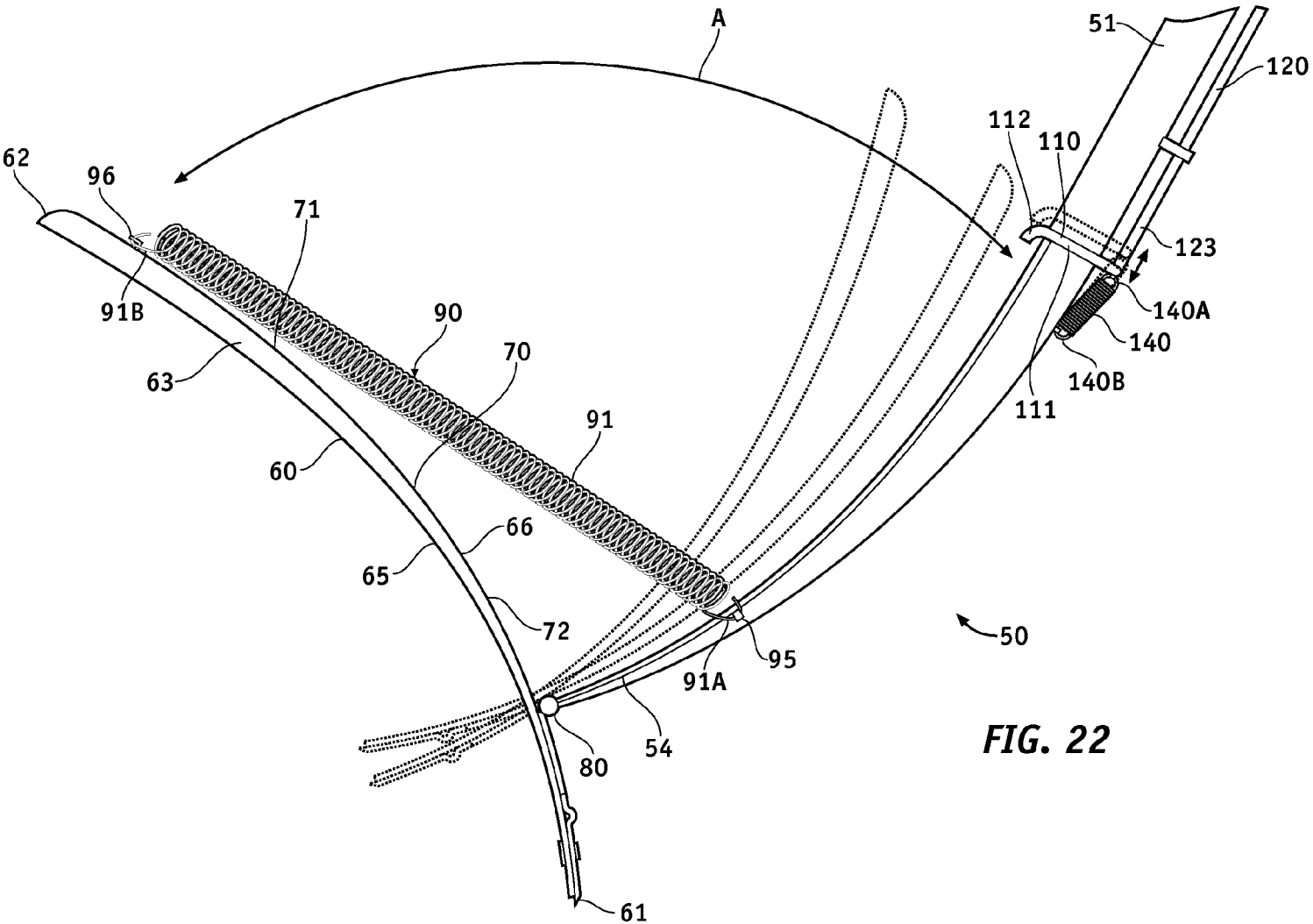
FIG. 22 is an enlarged, fragmented, partially schematic side elevation view of the snow removal shovel of FIG. 1 illustrating movement of the shovel blade from the snow shoveling position of the shovel blade to a snow dumping position of the shovel blade, and a spring assembly coupled between the shovel blade and the elongate support for biasing the shovel blade from the snow dumping position of the shovel blade to the snow shoveling position of the shovel blade.

Shovel blade 60 mounted to lower end 52 of elongate support for movement or displacement in the direction generally indicated by double arrowed line A in FIG. 19 between a snow shoveling position of shovel blade 60 as shown in FIGS. 1, 2, 6, 11, 14-17, and 21, and a snow dumping position of shovel blade 60 as shown in FIGS. 19 and 22. Specifically, and with reference to FIGS. 2 and 11, lower section 72 of rear side 66 of shovel blade 60 is mounted for pivotal movement to lower end 54 of elongate support 51 with a conventional hinge 80 formed, or otherwise coupled and secured between, lower end 54 of elongate support 51 and lower section 72 of rear side 66 of shovel blade 60. Hinge 80 is located alongside rear side 66 of shovel blade 60, is located between side edges 63 and 64 of shovel blade 60 and, more specifically, is located at the vertical geometric center of rear side 66 of shovel blade 60 such that hinge 80 is equidistant with respect to side edges 63 and 64. Hinge 80 is further located near ground engaging lower edge 61 of shovel blade 60 and between ground engaging lower edge 61 of shovel blade 60 and middle 70 of rear side 66 of shovel blade 60. With respect to the location of hinge 80 between ground engaging lower edge 61 of shovel blade 60 and middle 70 of rear side 66 of shovel blade 60, hinge 80 is located closer to ground engaging lower edge 61 of shovel blade 60 than middle 70 of rear side 66 of shovel blade 60, in which the distance between ground engaging lower edge 61 and hinge 80 is less than the distance between middle 70 and hinge 80, the distance between middle 70 and hinge 80 is less than the distance between upper edge 62 and middle 70, and the distance between upper edge 62 and hinge 80 is greater than the distance between upper edge 62 and middle 70, is greater than the distance between middle 70 and hinge 80, and is further greater than the distance between hinge 80 and ground engaging lower edge 61.

In the present example as previously described, the height of shovel blade 60 from ground engaging lower edge 61 to upper edge is fifteen inches, and the width of shovel blade 60 from side edge 63 to side edge 64 is eighteen inches. In the preferred embodiment of shovel blade 60 having this disclosed height and width of shovel blade 60, the distance between upper edge 62 and middle 70 and the distance between middle 70 and ground engaging lower edge 61 are each 7½ inches, the distance between middle 70 and hinge 80 is 4½ inches, the distance between hinge 80 and ground engaging lower edge 61 is 3 inches, and the distance between upper edge 62 and hinge is 12 inches. Based on these measurements, the distance between hinge 80 and ground engaging lower edge 61 is 66.7% of the distance between middle 70 and hinge 80 and is 25% of the distance between upper edge 62 and hinge 80, the distance between middle 70 and hinge 80 is 60% of the distance between upper edge 62 and middle 70 and the distance between ground engaging lower edge 61 and middle 70, the distance between upper edge 62 and middle 70 and the distance between ground engaging lower edge 61 and middle 70 are each 62.5% of the distance between upper edge 62 and hinge 80, and the distance between hinge 80 and ground engaging lower edge 61 is 40% of the distance between upper edge 62 and middle 70 and the distance between ground engaging lower edge 61 and middle 70, and is 20% of the overall height of shovel blade 60 from ground engaging lower edge 61 to upper edge 62.

Hinge 80 is, or otherwise defines, a pivot point between shovel blade 60 and lower end 54 of elongate support 51 about which shovel blade 60 pivots. Shovel blade 60 pivots about the pivot point defined by hinge 80 about a pivot axis P of hinge 80 denoted in FIG. 11, which is parallel with respect to ground engaging lower edge 61 of shovel blade 60 and upper edge 62 of shovel blade 60, and which is perpendicular with respect to side edges 63 and 64 of shovel blade 60, and which is further perpendicular with respect to the long axis of elongate support 51. Because the distance between hinge 80 and ground engaging lower edge 61 is 25% of the distance between upper edge 62 and hinge 80, the dimension of shovel blade 60 from upper edge 62 to pivot axis P of hinge 80 is four times greater than the dimension of shovel blade 60 from pivot axis P of hinge 80 to ground engaging lower edge 61. Hinge 80, and the relative positioning of hinge 80 as discussed above provides the necessary pivoting action of shovel blade 60 between the snow shoveling and snow dumping positions as described in this specification. Shovel blade 60 pivots at the pivot point at hinge 80 between the snow shoveling position of shovel blade 60 toward elongate support 51 as shown in FIGS. 1, 2, 6, 11, 14-17, and 21, and the snow dumping position of shovel blade 60 away from elongate support 51 as shown in FIGS. 19 and 22. In the snow shoveling position of shovel blade 60 as shown in FIGS. 1, 2, 6, 11, 14-17, and 21, shovel blade 60 is upright in preparation for use in shoveling and removing snow and, as best seen in FIGS. 2, 14-17, and 21, upper edge 62 of shovel blade 60 and rear side 66 of shovel blade 60 between the pivot point defined by or otherwise at hinge 80 and upper edge 62 of shovel blade 60 are positioned near, or are otherwise juxtaposed with respect to, elongate support 51. In the snow shoveling position of shovel blade 60 as shown in FIGS. 1, 2, 6, 11, 14-17, and 21, rear side 66 of shovel blade 60 between the pivot point defined by or otherwise at hinge 80 and upper edge 62 of shovel blade 60 preferably nests onto or against the front side elongate support 51, and the length of elongate support 51 that receives the rear side 66 of shovel blade 60 is preferably curved or otherwise contoured so as to conform to the convexity of rear side 66 of shovel blade 60.

In the snow shoveling position of shovel blade 50, shovel 50 is useful for removing show from an area requiring snow removal, such as shown in FIG. 16, which illustrates ground engaging lower edge 61 of shovel blade 60 engaging the ground and shovel 50 positioned upright with handgrip 53 shown as it would appear taken up by hand by a user intended to be in a standing position with the user's forearm positioned in cradle 55. With shovel 50 held upright in this way, front snow engaging side 65 of shovel blade 60 faces the snow to be removed, and shovel 50 is then pushed forwardly over and across the ground in a forward direction indicated by arrowed line X so as to scrape ground engaging lower edge 61 over the ground and move shovel blade 60 into the snow to be removed, which is collected by or otherwise along front snow engaging side 65 of shovel blade 60. Using shovel 50 in this way scrape up and push away snow is useful for clearing snow from a driveway, walkway, sidewalk, etc. In the snow dumping position of shovel blade 60 as shown in FIGS. 19 and 22, shovel is useful for dumping snow from shovel blade 60 previously collected by shovel blade 60 in the use of shovel 50 as described in conjunction with FIG. 16 in the snow shoveling position of shovel blade 60. In the snow dumping position of shovel blade 60, shovel blade 60 is displaced forwardly away from elongate support 51 and toward and into the collected snow in the direction indicated by arrowed line Y in FIG. 19 and shovel blade 60 is displaced near horizontally from and with respect to the snow shoveling position of shovel blade 60 and upper edge 62 of shovel blade 60 and rear side 66 of shovel blade 60 between the pivot point defined by or otherwise at hinge 80 and upper edge 62 of shovel blade 60 are positioned downwardly, forwardly, and away from elongate support 60 and, moreover, the position of upper edge 62 and rear side 66 of shovel blade 60 in the snow shoveling position of shovel blade 60. In the pivotal movement of shovel blade 60 at hinge 80 from the snow shoveling position shown in FIG. 16 to the snow dumping position as shown in FIG. 19, and with ground engaging lower edge 61 of shovel blade 60 engaged the ground over which the snow was cleared, ground engaging lower edge 61 is the fulcrum about which ground engaging lower edge 61 of shovel 60 pivots with respect to the ground over which the snow was cleared from the snow shoveling position of shovel blade 60 to the snow dumping position of shovel blade.

The location of the pivot point defined by hinge 80 near ground engaging lower edge 61 of shovel blade 60 and between ground engaging lower edge 61 of shovel blade 60 and middle 70 of rear side 66 of shovel blade 60 such that the dimension of shovel blade 60 from upper edge 62 to pivot axis P of hinge 80 is greater, namely, four times greater in a preferred embodiment, than the dimension of shovel blade 60 from pivot axis P of hinge 80 to ground engaging lower edge 61 as described above, promotes the described pivotal movement of shovel blade 60 about pivot axis P (FIG. 11) defined by and at hinge 80 between the snow shoveling and snow dumping positions of shovel blade 60, and limits a forward displacement of shovel 50 in the forward direction indicated by the arrowed line X in FIG. 16 in response to the pivoting of shovel blade 60 at the fulcrum defined between ground engaging lower edge 61 of shovel blade and the ground over which the snow was cleared in the use of shovel 50, and limits lateral displacement of shovel 50 relative to the fulcrum defined at and between ground engaging lower edge 61 of shovel blade 60 and the ground over which the snow was removed. Because pivot axis P of hinge 80 is spaced-apart upwardly with respect to ground engaging lower edge 61 of shovel blade 60, there will be a lateral movement or displacement of shovel 50 in the forward direction as indicated by arrowed line X in FIG. 19 away from the user wielding snow shovel 50 in response to pivotal movement of shovel blade 60 about the fulcrum defined between ground engaging lower edge 61 of shovel blade 60 and the ground over which the snow was removed that ground engaging lower edge 62 engages from the snow shoveling position of shovel blade 60 to the snow dumping position of shovel blade 60, and there will, accordingly, also be an opposite lateral movement or displacement of shovel 50 in the opposite rearward direction toward the user wielding snow shovel 50 in response to pivotal movement of shovel blade 60 about the fulcrum defined between ground engaging lower edge 61 of shovel blade 60 and the ground over which the snow was removed that ground engaging lower edge 62 engages from the snow dumping position of shovel blade 60 to the snow shoveling position of shovel blade 60. However, the location of hinge 80 near ground engaging lower edge 61 of shovel blade 60 as herein specifically described limits the described lateral displacement of shovel blade 60 in response to pivotal movement of shovel blade 60 between the snow shoveling position of shovel blade 60 and the snow dumping position of shovel blade 60, in accordance with the principle of the invention.

In accordance with the principle of the invention, it is to be emphasized that the location of the pivot point defined by hinge 80 near ground engaging lower edge 61 of shovel blade 60 and between ground engaging lower edge 61 of shovel blade 60 and middle 70 of rear side 66 of shovel blade 60 such that the dimension of shovel blade 60 from upper edge 62 to pivot axis P of hinge 80 is greater than the dimension of shovel blade 60 from pivot axis P of hinge 80 to ground engaging lower edge 61 as described above, promotes the described pivotal movement of shovel blade 60 about pivot axis P (FIG. 11) defined by and at hinge 80 between the snow shoveling and snow dumping positions of shovel blade 60, and limits the described lateral displacement of shovel blade 60 in response to pivotal movement of shovel blade 60 between the snow shoveling position of shovel blade 60 and the snow dumping position of shovel blade 60. Contrary to the invention, if the location of the pivot point defined by hinge 80 was not near ground engaging lower edge 61 of shovel blade 60 and was between middle 70 and upper edge 62 of shovel blade 60 such that the dimension of shovel blade 60 from upper edge 62 to pivot axis P of hinge 80 was less than the dimension of shovel blade 60 from pivot axis P of hinge 80 to ground engaging lower edge 61, disadvantageously the pivotal movement of shovel blade 60 between its snow shoveling and snow dumping positions in the use of shovel 50 in shoveling and dumping snow as herein specifically described would not be promoted, and the lateral displacement of shovel blade 60 about the fulcrum defined between ground engaging lower edge 61 and the ground over which the snow was removed and that ground engaging lower edge 61 engages would be exaggerated or otherwise exacerbated.

Referencing FIGS. 2 and 11, shovel 50 is formed with a spring assembly 90 coupled between shovel blade 60 and elongate support 51, and which acts between shovel blade 60 and elongate support 51 so as to bias shovel blade 60 into the snow shoveling position of shovel blade 60 and away from the snow dumping position of shovel blade 60. Specifically, spring assembly 90 coupled between rear side 66 of shovel blade 60 and elongate support 51. Spring assembly 90 consists of a plurality of springs, namely, springs 91 and 92. Spring 91 is a conventional and elongate helical or coil spring consisting of a wire having opposed tag ends 91A and 91B and which is formed into active coils between the opposed tag ends 91A and 91B. Spring 91 is an inwardly biased helical or coil spring, which stores energy when stretched or lengthened as shown in FIGS. 19 and 20 from an initial, resting, or shortened state as shown in FIGS. 2 and 11. Spring 92 is identical in every respect to spring 91 and, like spring 91, is a conventional and elongate helical or coil spring consisting of a wire having opposed tag ends 92A and 92B and which is formed into active coils between the opposed tag ends 92A and 92B. Like spring 91, spring is an inwardly biased helical or coil spring, which stores energy when stretched or lengthened as shown with spring 91 in FIGS. 19 and 20 from an initial, resting, or shortened state as shown in FIGS. 2 and 11.

As best illustrated in FIG. 11, elongate support 51 is formed with hooks 95 and 96, and upper section 71 of rear side 66 of shovel blade 60 is formed with hooks 98 and 99. Hooks 95 and 98 are opposite to one another and are formed in either side of elongate support 51 between hinge 80 and middle 70 of shovel blade 60. Hooks 96 and 99 are opposite to one another and are formed near upper edge 62 of shovel blade 60 near either side of shovel blade 60, in which hook 96 is formed near side edge 63 and hook 99 is formed near side edge 64. FIG. 22 is an enlarged, fragmented, partially schematic side elevation view of shovel 60 illustrating movement of shovel blade 60 from the snow shoveling position of shovel blade 60 to the snow dumping position of shovel blade 60, and which clearly illustrates hooks 95 and 96. Although hooks 98 and 99 are not similarly depicted as hooks 95 and 96 are illustrated in FIG. 22, it is to be understood that hook 98 is identical in every respect to hook 95, and that hook 99 is identical in every respect to hook 96.

Referencing FIGS. 11, and 22, tag end 91A of spring 91 is coupled to elongate support 51 at an attachment point consisting of hook 95 formed in elongate support 51 that is located between middle 70 of shovel blade 60 and hinge 80, and tag end 91B of spring 91 is coupled to rear side 66 of shovel blade 60 at an attachment point consisting of hook 96 formed in shovel blade 60 at upper section 71 of rear side 66 of shovel blade 60 near upper edge 62 of shovel blade 60 and side edge 63 of shovel blade 60. Tag end 91A of spring 91 is hooked onto hook 95 thereby hooking tag end 91A of spring 91 to elongate support 51, and tag end 91B of spring 91 is hooked onto hook 96 thereby hooking tag end 91B of spring 91 to upper section 71 of rear side 66 of shovel blade 60.

In the snow shoveling position of shovel blade as shown in FIGS. 2, 11, 15-17, and 21, spring 91 is shortened or otherwise in a shortened state. In the snow dumping position of shovel blade 60 as shown in FIG. 22, spring 91 is stretched between elongate support 51 and shovel blade 60 between tag ends 91A and 91B secured to elongate support 51 and shovel blade 60, respectively, and is thereby lengthened or otherwise changed or displaced from its shortened state to a lengthened state as shown in FIG. 22. In the stretched or lengthened state of spring 91 as shown in FIG. 22, spring 91 exerts a force proportional to its change in length from its shortened state thereby exerting a bias between elongate support 51 and shovel blade 60 biasing shovel blade 60 from the snow dumping position of shovel blade 60 as shown in FIG. 22 to the snow shoveling position of shovel blade 60 as shown in FIGS. 2, 11, 15-17, and 21.

Regarding spring 92 as illustrated in FIGS. 2 and 11, tag end 92A of spring 92 is coupled to elongate support 51 at an attachment point consisting of hook 98 formed in elongate support 51 that is located between middle 70 of shovel blade 60 and hinge 80, and tag end 92B of spring 92 is coupled to rear side 66 of shovel blade 60 at an attachment point consisting of hook 99 formed in shovel blade 60 at upper section 71 of rear side 66 of shovel blade 60 near upper edge 62 of shovel blade 60 and side edge 64 of shovel blade 60. Tag end 92A of spring 92 is hooked onto hook 98 thereby hooking tag end 92A of spring 92 to elongate support 51, and tag end 92B of spring 92 is hooked onto hook 99 thereby hooking tag end 92B of spring 92 to upper section 71 of rear side 66 of shovel blade 60.

Figure 14:
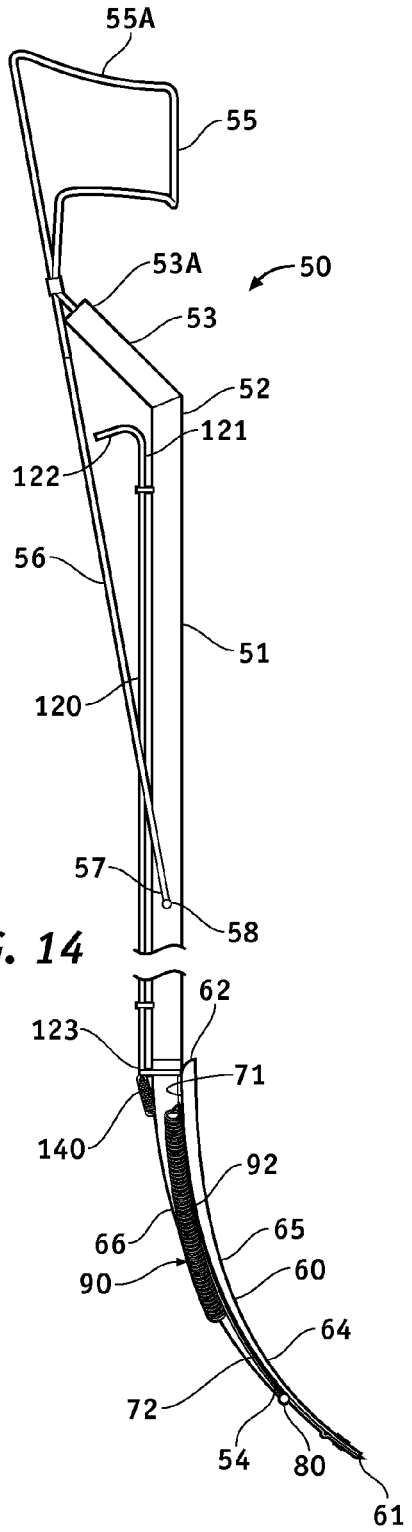
FIG. 14 is a right side elevation view of the embodiment of FIG. 1.
Figure 15:
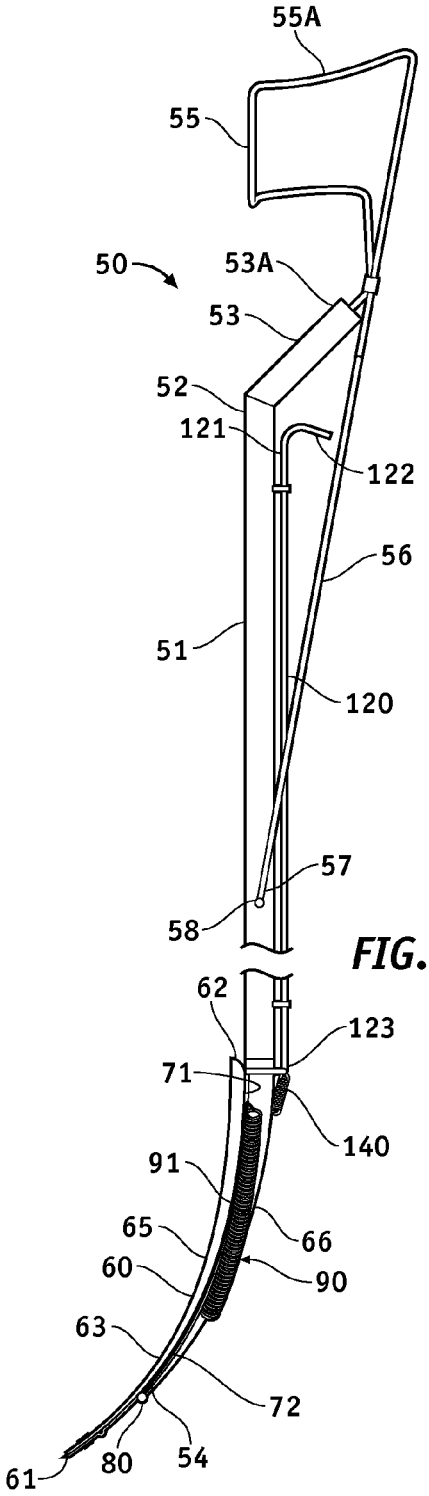
FIG. 15 is left side elevation view of the embodiment of FIG. 14.

The operation of spring 92 is identical in every respect to spring 91, whereby in the snow shoveling position of shovel blade as shown in FIGS. 2, 11, and 14, spring 92 is shortened or otherwise in a shortened state, and in the snow dumping position of shovel blade 60 spring 92 is stretched between elongate support 51 and shovel blade 60 between tag ends 92A and 92B secured to elongate support 51 and shovel blade 60, respectively, and is thereby lengthened or otherwise changed or displaced from its shortened state to a lengthened state. In the stretched or lengthened state of spring 92, spring 92 exerts a force proportional to its change in length from its shortened state thereby exerting a bias between elongate support 51 and shovel blade 60 biasing shovel blade 60 from the snow dumping position of shovel blade 60 to the snow shoveling position of shovel blade 60. Unlike with spring 91, the change in length of spring 92 between its shortened and lengthened states is not shown in the drawings. However, the operation and movement/displacement of spring 92 between shortened and lengthened states is identical in every respect to the operation and movement/displacement of spring 91 between its shortened and lengthened states as shown in the drawings, and it is to be understood that the description of the operation and movement/displacement of spring 91 between its shortened and lengthened states as shown and described applies in every respect to the operation and movement/displacement of spring 92 between its shortened and lengthened states.

As best seen in FIGS. 2 and 11, springs 91 and 92 of spring assembly 90 are coupled between elongate support 51 and upper section 71 of rear side 66 of shovel blade 60 on either side of elongate support 51. Springs 91 and 92 diverge outwardly and upwardly away from one another from tag ends 91A and 92A of springs 91 and 92 to tag ends 91B and 92B of springs 91 and 92. Springs 91 and 92 act between elongate support 51 and shovel blade 60 so as to bias shovel blade 60 into the snow shoveling position of shovel blade 60 as described above, in which springs 91 and 92 displace, namely, lengthen and shorten, in response to movement of shovel blade 60 between the snow shoveling and snow dumping positions so as to cooperate together to bias shovel blade 60 from the snow dumping position to the snow shoveling position, in accordance with the principle of the invention. Furthermore, in the snow shoveling position of shovel blade 60 in the shortened state of springs 91 and 92, springs 91 and 92 are somewhat stretched from a completely relaxed state so as to cooperate to bias shovel blade 60 into the snow shoveling position of shovel blade 60 and away from the snow dumping position of shovel blade 60.

Figure 3:
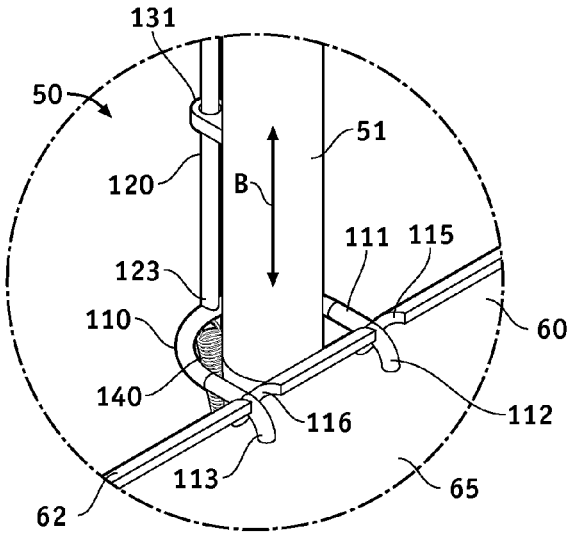
FIG. 3 is an enlarged, fragmented perspective view of the snow removal shovel of FIG. 1 illustrating the latch positioned in the locked position engaging an upper edge of the shovel blade securing the shovel blade in the snow shoveling position of the shovel blade, and an attachment of the elongate rod to the elongate support near the shovel blade.
Figure 7:
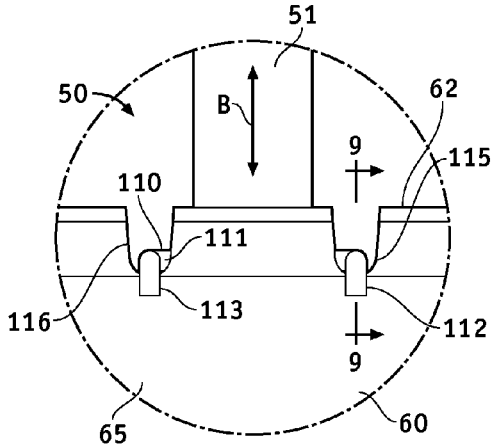
FIG. 7 is an enlarged, fragmented front elevation view of the snow removal shovel of FIG. 1 illustrating the latch positioned in the locked position engaging an upper edge of the shovel blade securing the shovel blade in the snow shoveling position of the shovel blade.
Figure 8:
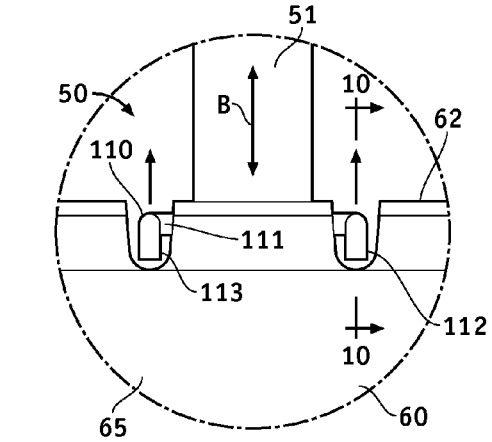
FIG. 8 is a view similar to that of FIG. 7 illustrating the latch positioned in an unlocked position disengaging the upper edge of the shovel blade releasing the shovel blade in the snow shoveling position of the shovel blade.
Figure 9:
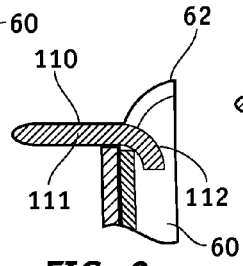
FIG. 9 is a section view taken along line 7-7 of FIG. 7.
Figure 10:
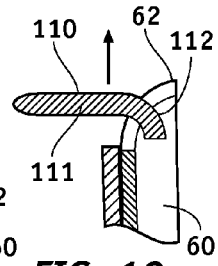
FIG. 10 is a section view taken along line 10-10 of FIG. 8.
Figure 12:
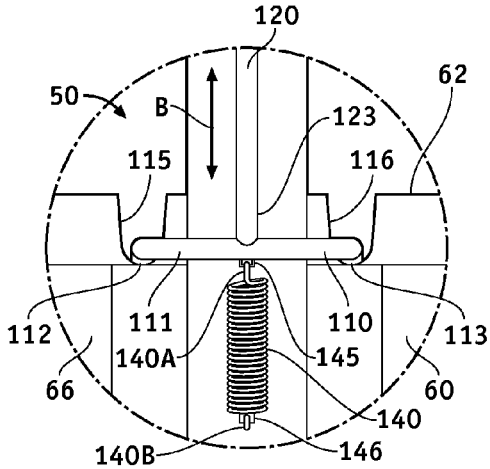
FIG. 12 is an enlarged, fragmented rear elevation view of the snow removal shovel of FIG. 1 illustrating the latch positioned in the locked position engaging an upper edge of the shovel blade securing the shovel blade in the snow shoveling position of the shovel blade, and a spring coupled between the latch and the elongate support for biasing the latch into the locked position and shown as it would appear in a shortened condition in the locked position of the latch.
Figure 13:
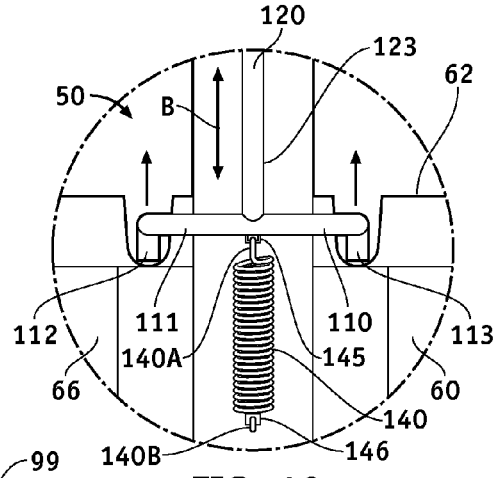
FIG. 13 is a view similar to that of FIG. 7 illustrating the latch positioned in an unlocked position disengaging the upper edge of the shovel blade releasing the shovel blade in the snow shoveling position of the shovel blade, and the spring coupled between the latch and the elongate support for biasing the latch into the locked position of FIG. 7 and shown as it would appear in a lengthened condition in the unlocked position of the latch.

Looking to FIGS. 1 and 2, shovel 50 is formed with a latch 90. Latch 90 is mounted to elongate support 51 for movement between a latched or locked position as shown in FIGS. 1-3, 5-7, 9, 11, and 12 for latching or otherwise engaging shovel blade 60 in the snow shoveling position of shovel blade 60 for securing shovel blade 60 in the snow shoveling position of shovel blade 60 and preventing shovel blade 60 from pivoting or otherwise displacing from the snow shoveling position of shovel blade 60 to the snow dumping position of shovel blade 60, and an unlatched or unlocked position as shown in FIGS. 8, 10, and 13 for unlatching or otherwise disengaging shovel blade 60 in the snow shoveling position of shovel blade 60 for releasing shovel blade 60 in the snow shoveling position of shovel blade 60 and permitting shovel blade 60 to pivot from the snow shoveling position of shovel blade to the snow dumping position of shovel blade 60. In this preferred embodiment, latch 90 is mounted to elongate support 51 for movement in reciprocal directions relative to upper edge 62 of shovel blade 60 in the snow shoveling position of shovel blade in the direction indicated by double arrowed line B in FIGS. 3, 7, 8, 12, and 13 between a lowered position of latch 110 toward upper edge 62 shovel blade 60 as shown in FIGS. 3, 7, and 12 defining the latched or locked position of latch 110 relative to shovel blade 60 latching or locking shovel blade 60 in the snow shoveling position of shovel blade 60, and a raised position of latch 110 away from shovel blade 60 as shown in FIGS. 8 and 13 defining the latched or locked position of latch 110 relative to shovel blade 60 unlatching or unlocking shovel blade 60 in the snow shoveling position of shovel blade 60.

As illustrated in FIG. 3, latch 110 is located near upper edge 62 of shovel blade 60 in the snow shoveling position of shovel blade 60 as shown in FIG. 3, and consists of a U-shaped member 111 having opposed, downturned tag or free ends 112 and 113. Elongate support 51 extends through U-shaped member 111 between free ends 112 and 113, and free ends 112 and 113 overly and extend over, and oppose and register with upper edge 62 of shovel blade 60 in the snow shoveling position of shovel blade 60. Specifically, free ends 112 and 113 oppose and register with corresponding notches 115 and 116 formed in upper edge 62 of shovel blade 60. Notches 115 and 116 are formed in upper edge 62 of shovel blade 60, and are considered part of or otherwise extensions of upper edge 62 of shovel blade 60. In the locked position of latch 110 in the snow shoveling position of shovel blade 62 as shown in FIGS. 3, 7, and 12, latch 110 is applied downwardly toward upper edge 62 of shovel blade 60 and free ends 112 and 113 are downwardly applied into notches 115 and 116, respectively, and the downturned portions of free ends 112 and 113, in turn, extend downwardly along front snow engaging side 65 of shovel blade 60 from notches 115 and 116, respectively, formed in upper edge 62 of shovel blade 60 as shown in FIGS. 3 and 7 to encounter and interfere with upper edge 62 of shovel blade 62 at notches 115 and 116, respectively, to secure and latch upper edge 62 of shovel blade 60 at notches 115 and 116, respectively, with latch 110 securing shovel blade 60 in the snow shoveling position. FIG. 9 is a section view taken along line 9-9 of FIG. 7 illustrating latch 110 as it would appear in the locked position with free end 112 applied downwardly toward upper edge 62 of shovel blade 60 into notch 115 and the downturned portion of free end 112, in turn, extend downwardly along front snow engaging side 65 of shovel blade 60 from notch 115 formed in upper edge 62 of shovel blade 60 encountering and interfering with upper edge 62 of shovel blade 62 at notch 115 thereby securing and latching upper edge 62 of shovel blade 60 at notch 115. Although not shown as in FIG. 9, the corresponding position of free end 113 of latch 110 with respect to notch 116 formed in upper edge 62 of shovel blade 60 is identical in every respect to that of free end 112 and notch 115 in the locked position of latch 110.

In the unlocked position of latch 110 in the snow shoveling position of shovel blade 62 as shown in FIGS. 8 and 13, latch 110 is applied upwardly away from upper edge 62 of shovel blade 60 and free ends 112 and 113 are removed from notches 115 and 116, respectively, unlatching and releasing or disengaging upper edge 62 of shovel blade 62 from latch 110 so as to cause latch 110 to be free from interfering with upper edge 62 of shovel blade 60 to, in turn, permit shovel blade 60 to pivot or otherwise displace between the snow shoveling position of shovel blade 60 and the snow dumping position of shovel blade 60. FIG. 10 is a section view taken along line 10-10 of FIG. 8 illustrating latch 110 as it would appear in the unlocked position with free end 112 applied upwardly and away from upper edge 62 and notch 115 of shovel blade 60 and free end 112 removed from notch 115 unlatching and releasing or disengaging upper edge 62 of shovel blade 62 from latch 110 so as to cause free end 112 to be free from interfering with upper edge 62 of shovel blade 60 to, in turn, permit shovel blade 60 to pivot or otherwise displace between the snow shoveling position of shovel blade 60 and the snow dumping position of shovel blade 60.

Looking back to FIGS. 1 and 2, shovel 60 is formed with an elongate rod 120 having an upper or proximal end 121 formed with a handle 122 located near and just under handgrip 53 formed in upper end 52 of elongate support 51, and an opposed lower or distal 123 end formed with latch 110. Elongate rod 120 is an extension of latch 110 and is considered a part of latch 110. The combination of latch 110 and elongate rod 120 formed with handle 122 is considered a latch assembly. Elongate rod 120 is located along the rear side of elongate support 51 opposite to the front side of elongate support 51, and extends along the length of elongate support 51 between the opposed forks and free ends 57 of brace 56 from upper or proximal end 121 formed with handle 122 located near and just under handgrip 53 of elongate support 51 to lower or distal 123 end formed with latch 110. Specifically, lower or distal end 123 of elongate rod 120 is secured to U-shaped member 11 at an intermediate location between free ends 112 and 113 of U-shaped member 111, and elongate rod 120 extends upwardly from lower or distal end 123 secured to U-shaped member 110 to upper or proximal end 121 formed with handle 122. Elongate rod 120 between upper or proximal end 121 formed with handle 122 and lower or distal end 123 formed with latch 110 is parallel with respect to elongate support 51.

Figure 4:
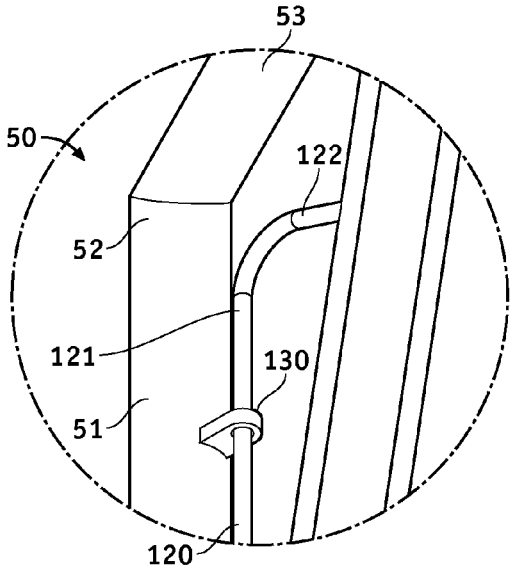
FIG. 4 is an enlarged, fragmented perspective view of the snow removal shovel of FIG. 1 illustrating the handle formed in the proximal end of the elongate rod near the handgrip of the elongate support, and an attachment of the elongate rod to the elongate support near the handgrip.

Elongate support 51 is formed with opposed brackets 130 and 131, which are affixed to elongate support 51. Elongate rod 120 is secured to elongate support 51 with brackets 130 and 131, which are coupled between elongate support 51 and elongate rod 120 as illustrated in FIGS. 1 and 2. Bracket 130 is located toward upper end 52 of elongate support 51 inside of and near handle 122 formed in upper or proximal end 121 of elongate rod 120 as shown in FIG. 4, and bracket 131 is located toward lower end 54 (not shown in FIG. 1) inside of and near latch 110 formed in lower or distal end 123 of elongate rod 120 as shown in FIGS. 3 and 4. Referencing FIGS. 3-5 in relevant part, elongate rod 120 extends through brackets 130 and 131, which encircle and couple elongate rod 120 to elongate support 51. Elongate rod 50 is free to reciprocate through brackets 130 and 131 in the direction indicated by the double arrowed line B in FIGS. 3 and 8 to, in turn, reciprocate latch 110 between the locked and unlocked positions of latch 110. And so reciprocal movement of elongate rod 12 in reciprocal directions in the direction indicated by the double arrowed line B in FIGS. 3 and 8 produces a corresponding reciprocal movement of latch 110 between its locked and unlocked positions. Activating rod 120 for reciprocal movement as described is preferably made at handle 122 formed in upper or proximal end 121 of elongate rod 120. In this regard, handle 122 is available to be taken up by handle to reciprocate rod 120 to reciprocally displace latch 110 between the locked and unlocked positions of latch 110. Because elongate rod 120 is coupled between handle 122 and latch 110, elongate rod 120 provides an operative coupling between handle 122 and latch 110, such that reciprocal movement of handle 122 imparts corresponding reciprocal movement of latch 110 between its locked and unlocked positions, in accordance with the principle of the invention. Also, handle 122 of elongate rod 120 is positioned near handgrip 53 so as to permit handle 122 and handgrip 53 to be concurrently taken up by hand as shown in FIG. 16 for wielding shovel at handgrip 53 during manual snow removal and for reciprocating elongate rod 120 at handle 122 for moving latch 110 between the locked and unlocked positions. With respect to latch 110, hinge 80 is not only located near ground engaging lower edge 61 of shovel blade 60 and between ground engaging lower edge 61 of shovel blade 60 and middle 70 of rear side 66 of shovel blade 60, hinge 80 is also located between ground engaging lower edge 61 and latch 110 as shown in FIGS. 2 and 11.

Figure 5:
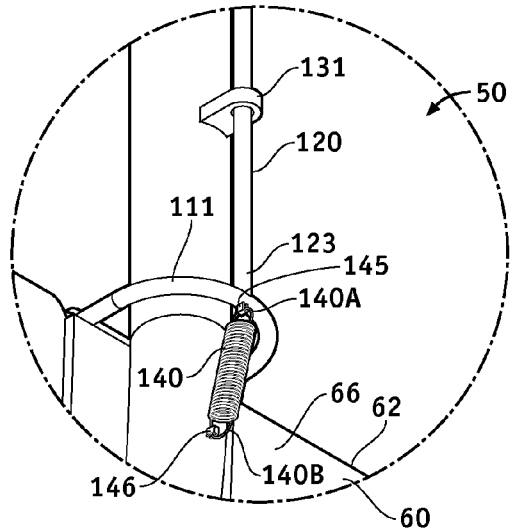
FIG. 5 is an enlarged, fragmented perspective view of the snow removal shovel of FIG. 1 illustrating the latch positioned on the locked position engaging an upper edge of the shovel blade securing the shovel blade in the snow shoveling position of the shovel blade, an attachment of the elongate rod to the elongate support near the shovel blade, and a spring coupled between the elongate support and the latch.
Figure 6:
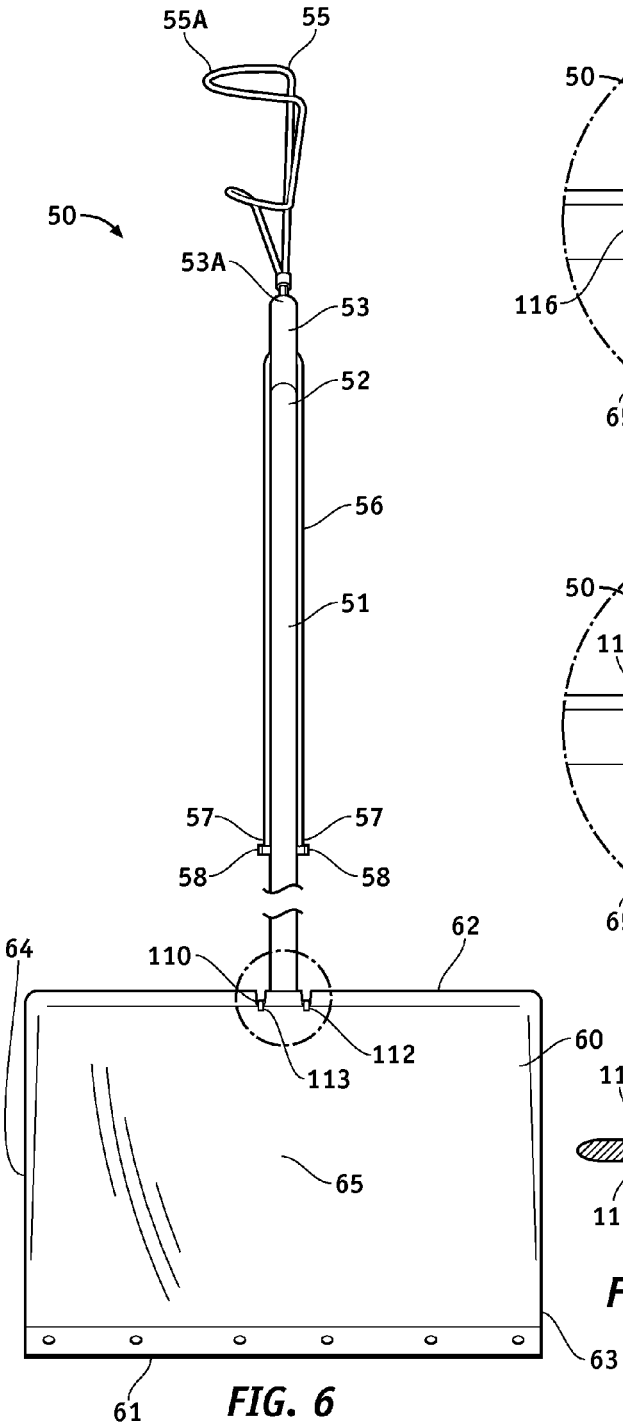
FIG. 6 is a front elevation view of the snow removal shovel of FIG. 1.

Referring now to FIGS. 5, 12, and 13, shovel 50 is formed with a spring 140 coupled between elongate support 51 and the latch assembly composed of latch 110 and elongate rod 120, and which acts between elongate support 51 and the latch assembly so as to bias latch 110 into the latched or locked position of latch 110 and away from the unlatched or unlocked position of latch 110. Specifically, spring 140 is coupled between latch 110 and elongate support 51.

Looking to FIGS. 12 and 13, spring 140 is a conventional and elongate helical or coil spring consisting of a wire having opposed tag ends 140A and 140B and which is formed into active coils between the opposed tag ends 140A and 140B. Spring 140 is an inwardly biased helical or coil spring, which stores energy when stretched or lengthened as shown in FIG. 13 from an initial, resting, or shortened state as shown in FIG. 12.

U-shaped member 111 of latch 110 is formed with an attached eyelet 145, and elongate support 51 is formed with an attached eyelet 146, which is located under latch 110 and upper edge 62 of shovel blade 60 and, more specifically, between, on the one hand, middle 70 and upper edge 62 of shovel blade 60 and, on the other hand, hooks 95 and 98 formed in elongate member 51 as previously discussed. Eyelet 145 is positioned along the underside of U-shaped member 111 and located at a central location of U-shaped member 111 that is equidistant with respect to free ends 112 and 113 of U-shaped member 111.

Tag end 140A of spring 140 is coupled to elongate latch 110 at an attachment point consisting of eyelet 145 formed in U-shaped member 111, and tag end 140B of spring 140 is coupled to elongate support 51 at an attachment point consisting of eyelet 146 formed in elongate member 51. Tag end 140A of spring 91 is hooked onto and through eyelet 145 thereby hooking tag end 140A of spring 140 to U-shaped member 111 of latch 110 so as to secure tag end 140A of spring 140 to U-shaped member 111 of latch 110, and tag end 140B of spring 140 is hooked onto and through eyelet 146 thereby hooking tag end 140B of spring 140 to elongate support 51 so as to secure tag end 140B of spring 140 to elongate support 51 at a location between latch 110 and middle 70 of shovel blade 60.

In the latched or locked position of latch 110 downwardly toward upper edge 62 of shovel blade 60 in the snow shoveling position of shovel blade 60 as shown in FIG. 12, spring 140 is shortened or otherwise in a shortened state. In the unlatched or unlocked position of latch 110 upwardly away from upper edge 62 of shovel blade 60 in the snow shoveling position of shovel blade 60 as shown in FIG. 13, spring 140 is stretched between latch 110 and elongate support 51 between tag ends 140A and 140B secured to elongate support 51 and latch 110, respectively, and is thereby lengthened or otherwise changed or displaced from its shortened state to a lengthened state as shown in FIG. 13. In the stretched or lengthened state of spring 140 as shown in FIG. 13, spring 140 exerts a force proportional to its change in length from its shortened state thereby exerting a bias between elongate support 51 and U-shaped member 111 of latch 110 biasing latch 110, and also the latch assembly as a whole, from the unlatched or unlocked position of latch 110 to the latched or locked position of shovel blade 60. And so in response to a force applied across the latch assembly of shovel 50, such as at handle 122, sufficient to overcome the bias applied by spring 140, latch 110 is moved from its latched or locked position as shown in FIG. 12 to its unlatched or locked position as shown in FIG. 13. When this force is removed, the bias applied by spring 140 between elongate support 51 and U-shaped member 111 of latch 110 of the latch assembly of shovel 50 moves the latch assembly from the unlatched or unlocked position of latch 110 as shown in FIG. 13 back to the latched or locked position of latch 110 as shown in FIG. 12.

Shovel 50 is useful for removing snow from an area requiring snow removal, such as driveway, a walkway, a sidewalk, or other area covered with snow. In the snow shoveling position of shovel blade 60 and with latch 110 in the latched or locked position securing shovel blade 60 in the snow shoveling position of shovel blade 50, shovel 50 is useful for removing snow from an area requiring snow removal, such as shown in FIG. 16, which, as previously described, illustrates ground engaging lower edge 61 of shovel blade 60 engaging the ground and shovel 50 positioned upright with handgrip 53 shown as it would appear taken up by hand by a user intended to be in an upright and standing position with the user's forearm positioned in cradle 55 allowing the user to shovel/remove snow while standing upright creating less fatigue and/or stress on the lower back as compared to bending over using a conventional snow shovel for the removal/shoveling of snow. With shovel 50 held upright in this way, front snow engaging side 65 of shovel blade 60 faces the snow to be removed, and shovel 50 is then pushed forwardly over and across the ground in the direction indicated by arrowed line X so as to scrape ground engaging lower edge 61 over the ground and move shovel blade 60 into the snow to be removed, which is collected by or otherwise along front snow engaging side 65 of shovel blade 60. Again, using shovel 50 in this way scrape up and push away snow is useful for clearing snow from a driveway, walkway, sidewalk, etc.

After a sufficient or desired amount of snow has been collected as in FIG. 16, shovel 50 is then useful for dumping the collected snow at a selected deposit site simply by moving shovel blade 60 from the snow shoveling position of shovel blade 60 as shown in FIG. 16 to the snow dumping position of shovel blade 60 as shown in FIG. 19. To move shovel blade 60 from the snow shoveling position of shovel blade 60 as shown in FIG. 16 to the snow dumping position of shovel blade 60 as shown in FIG. 19, shovel blade 60 is unlocked from the snow shoveling position of shovel blade 60 for permitting shovel blade 60 to pivot from the snow shoveling position of shovel blade 60 to the snow dumping position of shovel blade 60. To unlock shovel blade 60 from the snow shoveling position of shovel blade 60, latch 110 is moved from its latched or locked position in the snow shoveling position of shovel blade 60 as shown in FIG. 16 to its unlatched or unlocked position in the snow shoveling position of shovel blade 60 as shown in FIG. 17 disengaging latch 110 from shovel blade 60 in the snow shoveling position of shovel blade 60 thereby releasing shovel blade 60 in the snow shoveling position of shovel blade 60 so as to permit shovel blade 60 to pivot from the snow shoveling position of shovel blade 60 to the snow dumping position of shovel blade 60. To move latch 110 from the latched or locked position to the unlatched or unlocked position, a user taking up handgrip 53 by hand as seen in FIG. 16 may concurrently take up by the same hand and pull handle 122 of the latch assembly upwardly toward handgrip 53 in the direction indicated by arrowed line C with a force sufficient to overcome the bias applied by spring 140 so as to displace elongate rod 120 upwardly and away from shovel blade 60 to, in turn, move latch 110 from its lowered, latched, or locked position in FIG. 16 to its raised, unlatched, or unlocked position in FIG. 17 in preparation for moving shovel blade 60 from the snow shoveling position of shovel blade 60 to the snow dumping position of shovel blade 60.

With ground engaging lower edge 61 directed against the ground over which the snow was removed and collected and from the unlatched or unlocked position of latch 110 in the snow shoveling position of shovel blade 60 as shown in FIG. 17, to move shovel blade 60 from the snow shoveling position to the snow dumping position a user need only exert a force against elongate support 51, such as at handgrip 53 and cradle 55, to urge lower end 54 of elongate support 51 forwardly against rear side 66 of shovel blade 60 in the direction indicated by arrowed line X in FIG. 18 with a force sufficient to overcome the bias applied between elongate support 51 and shovel blade 60 by spring assembly 90 to initiate a pivoting of shovel blade 60 as shown in FIG. 18 out of the snow shoveling position of shovel blade 60 and toward the snow dumping position of shovel blade 60. Through a continued application of this force shovel blade 60 is made to pivot relative to lower end 54 of elongate support 51 at hinge 80 and to pivot relative to the ground over which the snow was removed at the fulcrum defined between ground engaging lower edge 61 and the ground over which the snow was removed from the snow shoveling position of shovel blade 60 to the snow dumping position of shovel blade 60 as seen in FIG. 19 so as to dump the collected snow forwardly and downwardly from front snow engaging side 65 of shovel blade 60.

Having dumped the snow by moving shovel blade 60 form the snow shoveling position of shovel blade 60 to the snow dumping position of shovel blade 60 as specifically described, shovel 60 may be reset to the snow shoveling position of shovel blade 60 for continued snow shoveling simply by reversing the action taken to move shovel blade 60 from the snow shoveling position of shovel blade 60 to the snow dumping position of shovel blade 60. Specifically, to move shovel blade 60 back to the snow shoveling position of shovel blade 60 from the snow dumping position of shovel blade 60 in FIG. 19, the force applied to shovel blade 60 from elongate support 51 used to overcome the bias applied by spring assembly 90 so as to move shovel blade 60 from the snow shoveling position of shovel blade 60 to the snow dumping position of shovel blade 60 is removed, and spring assembly 90 is responsive and acts between elongate support 51 and shovel blade 60 and drives shovel blade 60 back toward elongate support 51 in the direction indicated by arrowed line Z in FIG. 20 from the snow dumping position of shovel blade 60 in FIG. 19 back to the snow shoveling position of shovel blade 60 as shown in FIG. 21. With shovel blade 60 positioned back into the snow shoveling position of shovel blade 60 as in FIG. 21, the force applied to the latch assembly at handle 122 sufficient to overcome the bias applied by spring 140 to move the latch assembly into the unlatched or unlocked position of latch 110 is removed simply by releasing handle 122, and spring 140 is responsive and acts between latch 110 and elongate support 51 and drives the latch assembly back toward upper edge 62 of shovel blade 60 in the direction indicated by arrowed line D in FIG. 21 from the unlatched or unlocked position of latch 110 away from upper edge 62 of shovel blade 60 in the snow shoveling position of shovel blade 60 back to the latched or locked position of latch toward upper edge 62 of shovel blade 60 so as to cause latch 110 to engage and secure upper edge 62 of shovel blade 60 in the snow shoveling position of shovel blade 60 and, thereby, secure or otherwise lock shovel blade 60 in the snow shoveling position of shovel blade 60 Z in FIG. 20 from the snow dumping position of shovel blade 60 in FIG. 19 back to the snow shoveling position of shovel blade 60 as shown in FIG. 21 for continued use of shovel 50 for removing snow in the snow shoveling position of shovel blade 60. This process of moving shovel blade 60 between its snow shoveling and snow dumping positions is repeated as necessary for continued snow removal and dumping. As a matter of illustration and reference, FIG. 20 illustrates shovel blade 60 as it would appear located in an intermediate location between the snow shoveling position of shovel blade 60 and the snow dumping position of shovel blade 60.

After moving latch 110 into its unlatched position and moving shovel blade 60 from the snow shoveling position of shovel blade 60 to the snow dumping position of shovel blade 60 for dumping and depositing snow as described above, the force applied to the latch assembly at handle 122 sufficient to overcome the bias applied by spring 140 to move the latch assembly into the unlatched or unlocked position of latch 110 may be removed simply by releasing handle 122, whereby spring 140 is responsive and acts between latch 110 and elongate support 51 and drives the latch assembly from the unlatched or unlocked position of latch 110 back to the latched or locked position of latch 110. In this embodiment, to move shovel blade 60 back to the snow shoveling position of shovel blade 60 from the snow dumping position of shovel blade 60 in FIG. 19, the force applied to shovel blade 60 from elongate support 51 used to overcome the bias applied by spring assembly 90 so as to move shovel blade 60 from the snow shoveling position of shovel blade 60 to the snow dumping position of shovel blade 60 is removed, and spring assembly 90 is responsive and acts between elongate support 51 and shovel blade 60 and drives shovel blade 60 back toward elongate support 51 in the direction indicated by arrowed line Z in FIG. 20 from the snow dumping position of shovel blade 60 in FIG. 19 back to the snow shoveling position of shovel blade 60 as shown in FIG. 21, in which case upper section 61 of rear side 66 of shovel blade 60 near upper edge 62 of shovel blade 60 slams into free ends 112 and 113 of latch 110 causing latch to forcibly snap over notches 115 and 116 formed in upper edge 62. In this forcible application of shovel blade 60 against free ends 112 and 113 of latch 110, the bias applied by spring 140 biasing latch 110 into its latched or locked position is briefly and swiftly overcome, which causes the latch assembly to briefly displace out of its latched or locked position and toward and into its unlatched or unlocked position allowing shovel blade 60 to pass into its snow shoveling position, after which the bias applied by spring 140 between latch 110 and elongate support 51 swiftly snaps the latch assembly downwardly toward upper edge 62 into the latched or locked position of latch 110 causing latch to lock and secure shovel blade 60 in the snow shoveling position of shovel blade 60.

Because cradle 55 is an openwork, cradle defines a cradle handle 55A at the top or outer extremity or end of cradle 55 as shown in FIGS. 1, 2, 6, 11, and 14-21. This cradle handle 55A may be taken up by one hand by a user and elongate rod 51 may, in turn, be taken up by the other hand of user to allow shovel 50 to be taken up and wielded by two hands in the use of snow shovel 50 in snow removal and dumping operations as herein specifically described. Because handle 55A is formed in cradle 55, it is considered, therefore, a cradle handle 55A. Cradle handle 55A can be formed with cradle 55 in other ways as may be desired, such as through molding, attaching it to cradle 55 such as with adhesive or welding or with mechanical fasteners, etc., so as form such a handle in cradle 55 useful according to the description of cradle handle 55A as described above. Also, although spring assembly 90 incorporates two springs in the preferred embodiment for to supply the provided bias between shovel blade 60 and elongate support 51, namely, springs 91 and 92, less or more springs may be used in spring assembly 90 in alternate embodiments of shovel 50. Furthermore, although one spring 140 is coupled between elongate support 51 and latch 110 to supply the provided bias between latch 110 and elongate support 51, more springs may be used if so desired.

In the preferred embodiment of shovel 50 as herein specifically described, in size the height of shovel blade 60 from ground engaging lower edge 61 to upper edge is fifteen inches, and the width of shovel blade 60 from side edge 63 to side edge 64 is eighteen inches. Based on these disclosed height and width dimensions of shovel blade 60, the positioning or orienting of hinge 80 is described with particularity. While maintaining the preferred positional relationship of hinge 80 with respect the a shovel blade 60 to ensure the same or similar operation, a shovel constructed and arranged in accordance with the principle of the invention may incorporate a shovel blade of varying size as may be desired, including a shovel blade having larger height and/or width dimensions compared to shovel blade 60, or lesser height and/or width dimensions compared to shovel blade 60.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A snow removal shovel, comprising:

an elongate support having an upper end and an opposed lower end;

a shovel blade having a ground engaging lower edge and an opposed upper edge, opposed side edges, a front snow-engaging side and an opposed rear side;

the rear side of the shovel blade defines a middle between, and equidistant with respect to, the ground engaging lower edge and the upper edge, an upper section extending between the middle and the upper edge, and a lower section extending between the middle and the ground engaging lower edge;

the lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade;

the shovel blade pivots at the pivot point between a snow shoveling position of the shovel blade toward the elongate support and a snow dumping position of the shovel blade away from the elongate support;

in the snow shoveling position of the shovel blade the upper edge of the shovel blade and the rear side of the shovel blade between the pivot point and the upper edge of the shovel blade are juxtaposed with respect to the elongate support;

in the snow dumping position of the shovel blade the upper edge of the shovel blade and the rear side of the shovel blade between the pivot point and the upper edge of the shovel blade are positioned downwardly and away from the elongate support;

a latch mounted to the elongate support for movement between a locked position for engaging the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position for disengaging the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade;

a spring assembly coupled between the rear side of the shovel blade and the elongate support for biasing the shovel blade into the snow shoveling position of the shovel blade; and the spring assembly comprises a plurality of springs.

2. The snow removal shovel according to claim 1, further comprising a handle operatively coupled to the latch to move the latch between the locked and unlocked positions in response to movement of the handle between a locking position and an unlocking position.

3. The snow removal shovel according to claim 2, wherein the handle is located near the upper end of the elongate support.

4. The snow removal shovel according to claim 3, further comprising a spring coupled between the elongate support and the latch for biasing the latch into the locked position.

5. The snow removal shovel according to claim 4, further comprising a handgrip formed in the upper end of the elongate support.

6. The snow removal shovel according to claim 5, wherein the handle is positioned near the handgrip so as to permit the handle and the handgrip to be concurrently taken up by hand to wield the snow removal shovel and to move the handle between the locking and unlocking positions for moving the latch between the locked and unlocked positions.

7. The snow removal shovel according to claim 6, further comprising:

an arm-receiving cradle coupled to the handgrip;

a brace coupled between, on the one hand, the handgrip and the cradle and, on the other hand, an intermediate portion of the elongate support between the upper and lower ends of the elongate support; and the brace for providing leverage to the intermediate portion of the elongate support from the arm-receiving cradle and the handgrip.

8. The snow removal shovel according to claim 1, wherein the plurality of springs is coupled between the elongate support between the latch and the pivot point, and the upper section of the rear side of the shovel blade.

9. A snow removal shovel, comprising:

an elongate support having an upper end and an opposed lower end;

a shovel blade having a ground engaging lower edge and an opposed upper edge, opposed first and second side edges, a front snow-engaging side and an opposed rear side;

the rear side of the shovel blade defines a middle between and equidistant with respect to the ground engaging lower edge and the upper edge, an upper section extending between the middle and the upper edge, and a lower section extending between the middle and the ground engaging lower edge;

the lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade;

the shovel blade pivots at the pivot point between a snow shoveling position of the shovel blade toward the elongate support and a snow dumping position of the shovel blade away from the elongate support;

in the snow shoveling position of the shovel blade the upper edge of the shovel blade and the rear side of the shovel blade between the pivot point and the upper edge of the shovel blade are juxtaposed with respect to the elongate support;

in the snow dumping position of the shovel blade the upper edge of the shovel blade and the rear side of the shovel blade between the pivot point and the upper edge of the shovel blade are positioned downwardly and away from the elongate support;

a latch mounted to the elongate support for movement between a locked position for engaging the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position for disengaging the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade;

a spring assembly coupled between the rear side of the shovel blade and the elongate support for biasing the shovel blade into the snow shoveling position of the shovel blade; the spring assembly comprises a first spring having a first tag end coupled to the elongate support between the latch and the pivot point, a second tag end coupled to the upper section of the rear side of the shovel blade near the upper edge of the shovel blade and the first side edge of the shovel blade, and the first spring lengthening and shortening in response to movement of shovel blade between the snow shoveling and snow dumping positions; and a second spring having a third tag end coupled to the elongate support between the latch and the pivot point, a fourth tag end coupled to the upper section of the rear side of the shovel blade near the upper edge of the shovel blade and the second side edge of the shovel blade, and the second spring lengthening and shortening in response to movement of shovel blade between the snow shoveling and snow dumping positions.

10. The snow removal shovel according to claim 9, further comprising a handle operatively coupled to the latch to move the latch between the locked and unlocked positions in response to movement of the handle between a locking position and an unlocking position.

11. The snow removal shovel according to claim 10, wherein the handle is located near the upper end of the elongate support.

12. The snow removal shovel according to claim 11, further comprising a spring coupled between the elongate support and the latch for biasing the latch into the locked position.

13. The snow removal shovel according to claim 12, further comprising a handgrip formed in the upper end of the elongate support.

14. The snow removal shovel according to claim 13, wherein the handle is positioned near the handgrip so as to permit the handle and the handgrip to be concurrently taken up by hand to wield the snow removal shovel and to move the handle between the locking and unlocking positions for moving the latch between the locked and unlocked positions.

15. The snow removal shovel according to claim 14, further comprising:

an arm-receiving cradle coupled to the handgrip;

a brace coupled between, on the one hand, the handgrip and the cradle and, on the other hand, an intermediate portion of the elongate support between the upper and lower ends of the elongate support; and the brace for providing leverage to the intermediate portion of the elongate support from the arm-receiving cradle and the handgrip.

16. A snow removal shovel, comprising:

an elongate support having an upper end formed with a handgrip, and an opposed lower end;

a shovel blade having a ground engaging lower edge and an opposed upper edge, opposed first and second side edges, a front snow-engaging side and an opposed rear side;

the rear side of the shovel blade defines a middle between and equidistant with respect to the ground engaging lower edge and the upper edge, an upper section extending between the middle and the upper edge, and a lower section extending between the middle and the ground engaging lower edge;

the lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade;

the shovel blade pivots at the pivot point between a snow shoveling position of the shovel blade toward the elongate support and a snow dumping position of the shovel blade away from the elongate support;

in the snow shoveling position of the shovel blade the upper edge of the shovel blade and the rear side of the shovel blade between the pivot point and the upper edge of the shovel blade are juxtaposed with respect to the elongate support;

in the snow dumping position of the shovel blade the upper edge of the shovel blade and the rear side of the shovel blade between the pivot point and the upper edge of the shovel blade are positioned downwardly and away from the elongate support;

an elongate rod having a proximal end formed with a handle and an opposed distal end formed with a latch;

the elongate rod carried by the elongate support and extending along the elongate support from the handle located near the handgrip, and the latch located near the upper edge of the shovel blade;

the elongate rod further being mounted to the elongate support for reciprocal movement between a locked position of the latch engaging the upper edge of the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position of the latch disengaging the upper edge of the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade; and the handle being positioned near the handgrip so as to permit the handle and the handgrip to be concurrently taken up by hand for wielding the snow removal shovel and for reciprocating the elongate rod for moving the latch between the locked and unlocked positions.

17. The snow removal shovel according to claim 16, wherein the elongate rod between the proximal and distal ends is parallel with respect to the elongate support.

18. The snow removal shovel according to claim 16, further comprising a spring coupled between the elongate support and the latch for biasing the elongate rod into the locked position of the latch.

19. The snow removal shovel according to claim 16, further comprising:

an arm-receiving cradle coupled to the handgrip;

a brace coupled between, on the one hand, the handgrip and the cradle and, on the other hand, an intermediate portion of the elongate support between the upper and lower ends of the elongate support; and the brace for providing leverage to the intermediate portion of the elongate support from the arm-receiving cradle and the handgrip.

20. The snow removal shovel according to claim 16, further comprising a spring assembly coupled between the rear side of the shovel blade and the elongate support for biasing the shovel blade into the snow shoveling position of the shovel blade.

21. The snow removal shovel according to claim 20, wherein the spring assembly comprises:

a first spring having a first tag end coupled to the elongate support between the latch and the pivot point, a second tag end coupled to the upper section of the rear side of the shovel blade near the upper edge of the shovel blade and the first side edge of the shovel blade, and the first spring lengthening and shortening in response to movement of shovel blade between the snow shoveling and snow dumping positions; and a second spring having a third tag end coupled to the elongate support between the latch and the pivot point, a fourth tag end coupled to the upper section of the rear side of the shovel blade near the upper edge of the shovel blade and the second side edge of the shovel blade, and the second spring lengthening and shortening in response to movement of shovel blade between the snow shoveling and snow dumping positions.

22. A snow removal shovel, comprising:

an elongate support having an upper end and an opposed lower end;

a shovel blade having a ground engaging lower edge and an opposed upper edge, opposed first and second side edges, a front snow-engaging side and an opposed rear side;

the rear side of the shovel blade defines a middle between and equidistant with respect to the ground engaging lower edge and the upper edge, an upper section extending between the middle and the upper edge, and a lower section extending between the middle and the ground engaging lower edge;

the lower section of the shovel blade is mounted for pivotal movement to the lower end of the elongate support at a pivot point located near the ground engaging lower edge of the shovel blade and between the ground engaging lower edge of the shovel blade and the middle of rear side of the shovel blade;

the shovel blade pivots at the pivot point between a snow shoveling position of the shovel blade toward the elongate support and a snow dumping position of the shovel blade away from the elongate support;

in the snow shoveling position of the shovel blade the upper edge of the shovel blade and the rear side of the shovel blade between the pivot point and the upper edge of the shovel blade are juxtaposed with respect to the elongate support;

in the snow dumping position of the shovel blade the upper edge of the shovel blade and the rear side of the shovel blade between the pivot point and the upper edge of the shovel blade are positioned downwardly and away from the elongate support;

a latch mounted to the elongate support for movement between a locked position for engaging the shovel blade in the snow shoveling position of the shovel blade for securing the shovel blade in the snow shoveling position of the shovel blade and preventing the shovel blade from pivoting from the snow shoveling position of the shovel blade to the snow dumping position of the shovel blade, and an unlocked position for disengaging the shovel blade in the snow shoveling position of the shovel blade for releasing the shovel blade in the snow shoveling position of the shovel blade and permitting the shovel blade to pivot from the snow shoveling position of the shovel blade to the snow dumping position of the shovel blade; and a spring for biasing the shovel blade into the snow shoveling position of the shovel blade, the spring has a first tag end coupled to the elongate support between the latch and the pivot point, a second tag end coupled to the upper section of the rear side of the shovel blade near the upper edge of the shovel blade, and the spring lengthening and shortening in response to movement of shovel blade between the snow shoveling and snow dumping positions.

* * * * *